US008733675B2

(12) United States Patent
Leber

(10) Patent No.: US 8,733,675 B2
(45) Date of Patent: May 27, 2014

(54) CONVERGING SPRAY SHOWERHEAD

(75) Inventor: Leland C. Leber, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 740 days.

(21) Appl. No.: 11/738,291

(22) Filed: Apr. 20, 2007

(65) Prior Publication Data

US 2007/0246577 A1 Oct. 25, 2007

Related U.S. Application Data

(60) Provisional application No. 60/745,261, filed on Apr. 20, 2006.

(51) Int. Cl.
*A62C 31/02* (2006.01)

(52) U.S. Cl.
USPC ..... 239/589; 239/436

(58) Field of Classification Search
CPC ..... B05B 1/08; B05B 12/14
USPC ..... 239/589, 590.3, 590.5, 597, 548, 558, 239/561, 587.5, 436, 391, 393, 394
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

Color Copy, Labeled 1A, Gemlo, available at least as early as Dec. 2, 1998.

(Continued)

*Primary Examiner* — Davis Hwu
(74) *Attorney, Agent, or Firm* — Dorsey & Whitney LLP

(57) ABSTRACT

Showerheads with two or more nozzles configured to deliver water streams that converge at one or more regions. Prior to convergence, the converging water streams may generally retain a recognizable shape determined by the type of nozzle. Upon convergence, at least portions of the converging water streams may substantially disperse into multiple individual water droplets. The nozzles, or a face plate or other components joining the nozzles to a showerhead, may be selectively movable to selectively move the region or regions of convergence closer to or further away from the showerhead, or to convert the nozzles from delivering converging streams to delivering non-converging streams or vice versa. Some showerheads may further include other nozzles for delivering water from the showerhead in other modes, such a high pressure mode, a pulsating mode, a mist mode, and so on.

24 Claims, 17 Drawing Sheets

(56) References Cited

U.S. PATENT DOCUMENTS

| | | | |
|---|---|---|---|
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Jublin |
| 3,762,648 | A | 10/1973 | Deines et al. |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |
| 3,845,291 | A | 10/1974 | Portyrata |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |

(56) References Cited

U.S. PATENT DOCUMENTS 3,910,277 A 10/1975 Zimmer
D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,963,179 A 6/1976 Tomaro
3,967,783 A * 7/1976 Halsted et al. ..... 239/381
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrow
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.

(56) References Cited

U.S. PATENT DOCUMENTS

D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szymanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.

(56) References Cited

U.S. PATENT DOCUMENTS

D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,697,557 A 12/1997 Blessing et al.
5,699,964 A 12/1997 Bergmann et al.
5,702,057 A 12/1997 Huber
D389,558 S 1/1998 Andrus
5,704,080 A 1/1998 Kuhne
5,707,011 A 1/1998 Bosio
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook
D395,142 S 6/1998 Neibrook
5,764,760 A 6/1998 Grandbert et al.
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,826,803 A 10/1998 Cooper
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,941,462 A 8/1999 Sandor
5,947,388 A 9/1999 Woodruff
D415,247 S 10/1999 Haverstraw et al.
5,961,046 A 10/1999 Joubran
5,967,417 A 10/1999 Mantel
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.

(56) References Cited

U.S. PATENT DOCUMENTS

D426,290 S 6/2000 Haug et al.
D427,661 S 7/2000 Haverstraw et al.
D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse
D433,097 S 10/2000 Tse
6,126,091 A 10/2000 Heitzman
6,126,290 A 10/2000 Veigel
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao et al.
6,230,989 B1 5/2001 Haverstraw et al.
D443,335 S 6/2001 Andrus
D443,336 S 6/2001 Kollmann et al.
D443,347 S 6/2001 Gottwald
6,241,166 B1 6/2001 Overington et al.
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 11/2001 Guo
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
6,336,764 B1 1/2002 Liu
6,338,170 B1 1/2002 De Simone
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,463,658 B1 10/2002 Larsson
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
6,508,415 B2 1/2003 Wang
6,511,001 B1 1/2003 Huang
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,585,174 B1 7/2003 Huang
6,595,439 B1 7/2003 Chen
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
6,691,933 B1 2/2004 Bosio
D487,301 S 3/2004 Haug et al.
D487,498 S 3/2004 Blomstrom
6,701,953 B2 3/2004 Agosta
6,715,699 B1 4/2004 Greenberg et al.
6,719,218 B2 4/2004 Cool et al.
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin
D494,661 S 8/2004 Zieger et al.
D495,027 S 8/2004 Mazzola
6,776,357 B1 8/2004 Naito
6,789,751 B1 9/2004 Fan
D496,987 S 10/2004 Glunk
D497,974 S 11/2004 Haug et al.
D498,514 S 11/2004 Haug et al.
D500,121 S 12/2004 Blomstrom
D500,549 S 1/2005 Blomstrom
D501,242 S 1/2005 Blomstrom
D502,760 S 3/2005 Zieger et al.
D502,761 S 3/2005 Zieger et al.
D503,211 S 3/2005 Lin
6,863,227 B2 3/2005 Wollenberg et al.
6,869,030 B2 3/2005 Blessing et al.
D503,774 S 4/2005 Zieger
D503,775 S 4/2005 Zieger
D503,966 S 4/2005 Zieger
6,899,292 B2 5/2005 Titinet
D506,243 S 6/2005 Wu
D507,037 S 7/2005 Wu
6,935,581 B2 8/2005 Titinet
D509,280 S 9/2005 Bailey et al.
D509,563 S 9/2005 Bailey et al.
D510,123 S 9/2005 Tsai

(56) References Cited

U.S. PATENT DOCUMENTS

| | | | | |
|---|---|---|---|---|
| D511,809 | S | 11/2005 | Haug et al. | |
| D512,119 | S | 11/2005 | Haug et al. | |
| 6,981,661 | B1 | 1/2006 | Chen | |
| D516,169 | S | 2/2006 | Wu | |
| 7,000,854 | B2 | 2/2006 | Malek et al. | |
| 7,004,409 | B2 | 2/2006 | Okubo | |
| 7,004,410 | B2 | 2/2006 | Li | |
| D520,109 | S | 5/2006 | Wu | |
| 7,040,554 | B2 | 5/2006 | Drennow | |
| 7,048,210 | B2 | 5/2006 | Clark | |
| 7,055,767 | B1 * | 6/2006 | Ko | 239/587.4 |
| 7,070,125 | B2 | 7/2006 | Williams et al. | |
| 7,077,342 | B2 | 7/2006 | Lee | |
| D527,440 | S | 8/2006 | Macan | |
| 7,093,780 | B1 | 8/2006 | Chung | |
| 7,097,122 | B1 | 8/2006 | Farley | |
| D528,631 | S | 9/2006 | Gillette et al. | |
| 7,100,845 | B1 | 9/2006 | Hsieh | |
| 7,111,795 | B2 | 9/2006 | Thong | |
| 7,111,798 | B2 | 9/2006 | Thomas et al. | |
| D530,389 | S | 10/2006 | Genslak et al. | |
| D530,392 | S | 10/2006 | Tse | |
| D531,259 | S | 10/2006 | Hsieh | |
| 7,114,666 | B2 | 10/2006 | Luettgen et al. | |
| D533,253 | S | 12/2006 | Luettgen et al. | |
| D534,239 | S | 12/2006 | Dingler et al. | |
| D535,354 | S | 1/2007 | Wu | |
| D536,060 | S | 1/2007 | Sadler | |
| 7,156,325 | B1 | 1/2007 | Chen | |
| D538,391 | S | 3/2007 | Mazzola | |
| D540,424 | S | 4/2007 | Kirar | |
| D540,425 | S | 4/2007 | Endo et al. | |
| D540,426 | S | 4/2007 | Cropelli | |
| D540,427 | S | 4/2007 | Bouroullec et al. | |
| D542,391 | S | 5/2007 | Gilbert | |
| D542,393 | S | 5/2007 | Haug et al. | |
| 7,229,031 | B2 | 6/2007 | Schmidt | |
| 7,243,863 | B2 | 7/2007 | Glunk | |
| 7,246,760 | B2 | 7/2007 | Marty et al. | |
| D552,713 | S | 10/2007 | Rexach | |
| 7,278,591 | B2 | 10/2007 | Clearman et al. | |
| D556,295 | S | 11/2007 | Genord et al. | |
| 7,299,510 | B2 | 11/2007 | Tsai | |
| D557,763 | S | 12/2007 | Schonherr et al. | |
| D557,764 | S | 12/2007 | Schonherr et al. | |
| D557,765 | S | 12/2007 | Schonherr et al. | |
| D558,301 | S | 12/2007 | Hoernig | |
| 7,303,151 | B2 | 12/2007 | Wu | |
| D559,357 | S | 1/2008 | Wang et al. | |
| D559,945 | S | 1/2008 | Patterson et al. | |
| D562,937 | S | 2/2008 | Schonherr et al. | |
| D562,938 | S | 2/2008 | Blessing | |
| D562,941 | S | 2/2008 | Pan | |
| 7,331,536 | B1 | 2/2008 | Zhen et al. | |
| 7,347,388 | B2 | 3/2008 | Chung | |
| D565,699 | S | 4/2008 | Berberet | |
| D566,228 | S | 4/2008 | Neagoe | |
| D566,229 | S | 4/2008 | Rexach | |
| D567,328 | S | 4/2008 | Spangler et al. | |
| 7,360,723 | B2 | 4/2008 | Lev | |
| 7,364,097 | B2 | 4/2008 | Okuma | |
| 7,374,112 | B1 | 5/2008 | Bulan et al. | |
| 7,384,007 | B2 | 6/2008 | Ho | |
| D577,099 | S | 9/2008 | Leber | |
| D577,793 | S | 9/2008 | Leber | |
| D580,012 | S | 11/2008 | Quinn et al. | |
| D580,513 | S | 11/2008 | Quinn et al. | |
| D581,014 | S | 11/2008 | Quinn et al. | |
| 7,503,345 | B2 | 3/2009 | Paterson et al. | |
| 7,537,175 | B2 | 5/2009 | Miura et al. | |
| 7,832,662 | B2 | 11/2010 | Gallo | |
| 8,292,200 | B2 | 10/2012 | Macan et al. | |
| 2002/0109023 | A1 | 8/2002 | Thomas et al. | |
| 2003/0062426 | A1 | 4/2003 | Gregory et al. | |
| 2004/0074993 | A1 | 4/2004 | Thomas et al. | |
| 2004/0118949 | A1 | 6/2004 | Marks | |
| 2004/0217209 | A1 | 11/2004 | Bui | |
| 2004/0244105 | A1 | 12/2004 | Tsai | |
| 2005/0001072 | A1 * | 1/2005 | Bolus et al. | 239/548 |
| 2005/0061896 | A1 | 3/2005 | Luettgen et al. | |
| 2005/0082824 | A1 | 4/2005 | Luettgen et al. | |
| 2005/0284967 | A1 | 12/2005 | Korb | |
| 2006/0016908 | A1 | 1/2006 | Chung | |
| 2006/0016913 | A1 | 1/2006 | Lo | |
| 2006/0043214 | A1 | 3/2006 | Macan et al. | |
| 2006/0060678 | A1 | 3/2006 | Mazzola | |
| 2006/0102747 | A1 | 5/2006 | Ho | |
| 2006/0157590 | A1 | 7/2006 | Clearman et al. | |
| 2006/0163391 | A1 | 7/2006 | Schorn | |
| 2006/0219822 | A1 | 10/2006 | Miller et al. | |
| 2006/0283986 | A1 | 12/2006 | Chung | |
| 2007/0040054 | A1 | 2/2007 | Farzan | |
| 2007/0200013 | A1 | 8/2007 | Hsiao | |
| 2007/0252021 | A1 | 11/2007 | Cristina | |
| 2007/0272770 | A1 | 11/2007 | Leber et al. | |
| 2008/0073449 | A1 | 3/2008 | Haynes et al. | |
| 2008/0083844 | A1 | 4/2008 | Leber et al. | |
| 2008/0111004 | A1 | 5/2008 | Huffman | |
| 2008/0223957 | A1 | 9/2008 | Schorn | |
| 2008/0272203 | A1 | 11/2008 | Leber | |
| 2008/0272591 | A1 | 11/2008 | Leber | |
| 2011/0011953 | A1 | 1/2011 | Macan et al. | |
| 2011/0121098 | A1 | 5/2011 | Luettgen et al. | |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| DE | 202005000881 | 3/2005 |
| EP | 0167063 | 6/1985 |
| EP | 0478999 | 4/1992 |
| EP | 0514753 | 11/1992 |
| EP | 0435030 | 7/1993 |
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |

(56) References Cited

FOREIGN PATENT DOCUMENTS

| | | |
|---|---|---|
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NE | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |

OTHER PUBLICATIONS

Color Copy, Labeled 1B, Gemlo, available at least as early as Dec. 2, 1998.

International Search Report, PCT/US07/67141, 8 pages, Jul. 2, 2008.

Author Unknown, "Flipside: The Bold Look of Kohler," 1 page, at least as early as Jun. 2011.

* cited by examiner

CONVERGING SPRAY SHOWERHEAD

CROSS-REFERENCE TO RELATED APPLICATIONS

This application claims the benefit under 35 U.S.C. §119 (e) of U.S. Provisional Application No. 60/745,261, entitled "Converging Spray Showerhead" and filed on Apr. 20, 2006, which is hereby incorporated by reference herein in its entirety.

BACKGROUND OF THE INVENTION a. Field of the Invention

The present invention generally relates to showerheads.

b. Background Art

Standard showerheads typically provide spray patterns of generally parallel or diverging round water streams, hollow water cones, fan shaped water streams, or fine mist sprays. These spray patterns are generally adequate to supply water for a shower. However, it may be desirable to have a showerhead that reduces the amount of water needed to provide adequate water coverage during a shower and/or to improve the spray pattern's feel or visual appeal. Accordingly, what is needed in the art is an improved showerhead.

BRIEF SUMMARY OF THE INVENTION

The present invention includes showerhead systems for causing water streams or sprays delivered from a showerhead to at least partially break into multiple, random water drops prior to contacting a user. The showerhead system may include a showerhead with two or more nozzles configured to cause water streams or sprays to converge at one or more regions in space, and/or one or more nozzles that deliver a rotating water stream or spray with a sufficient angular velocity to break the stream or spray into multiple droplets. The showerhead system may include a showerhead and one or more structures operatively associated with the showerhead that cause one or more water streams or sprays to break into multiple droplets upon impact with the structure.

One embodiment of a showerhead may take the form of a water inlet and a plurality of nozzles. The plurality of nozzles may be in fluid communication with the water inlet. At least two of the plurality of nozzles may be configured such that water streams exiting the at least two of the plurality of nozzles converge at least at one region to substantially convert at least portions of the water streams into multiple water droplets. The showerhead may further include a body defining at least one flow path for fluidly joining the water inlet to at least one of the plurality of nozzles. At least one of the at least one region may be selectively movable relative to the showerhead.

DETAILED DESCRIPTION OF THE INVENTION

Described herein are showerhead systems for causing water streams or sprays delivered from a showerhead to at least partially break into multiple, random water drops prior to contacting a user. In some embodiments, the showerhead system may take the form of a showerhead with two or more nozzles configured to deliver water streams or sprays (which may be referred to as streams and/or sprays hereinafter) that converge at one or more regions. Prior to convergence, the converging water streams may generally retain a recognizable shape determined by the type of nozzle. Upon convergence, at least a portion of the converging water streams may substantially disperse into multiple individual water droplets. The resultant water droplets may provide a more uniform distribution of water than individual streams or cones of water as supplied by conventional showerheads, which may result in the use of less water than a conventional showerhead to achieve a similar water coverage and/or wet feel. Further, the resultant water droplet distribution may have a pleasing feel similar to the feel of rain droplets from a sudden heavy rain such as a cloud burst and/or an aesthetically pleasing visual spray pattern.

In some embodiments, the showerhead system may take the form of a showerhead including one or more nozzles that deliver a rotating water stream or spray with a sufficient angular velocity to break the stream or spray into multiple droplets. In some embodiments, the showerhead system may include a showerhead and one or more structures operatively associated with the showerhead that cause one or more water streams or sprays to break into multiple droplets upon impact with the structure. Any of the various embodiments, may incorporate features of other embodiments to provide multiple approaches in a showerhead system to at least partially break water streams or sprays delivered from the showerhead system into multiple, random water drops.

Figure 1A:
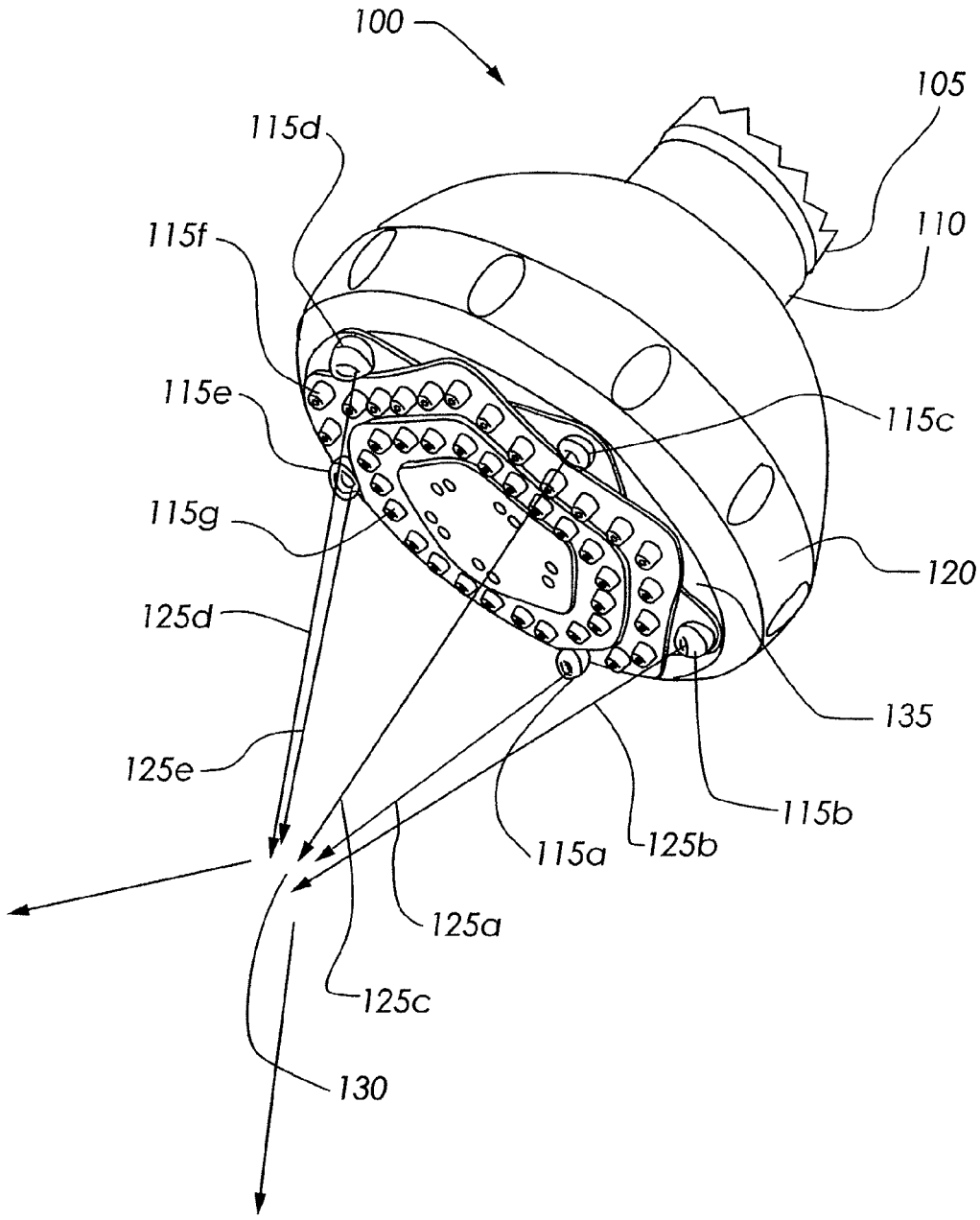
FIG. 1A is a front perspective view of a first example of a showerhead with converging streams shown schematically.
Figure 1B:
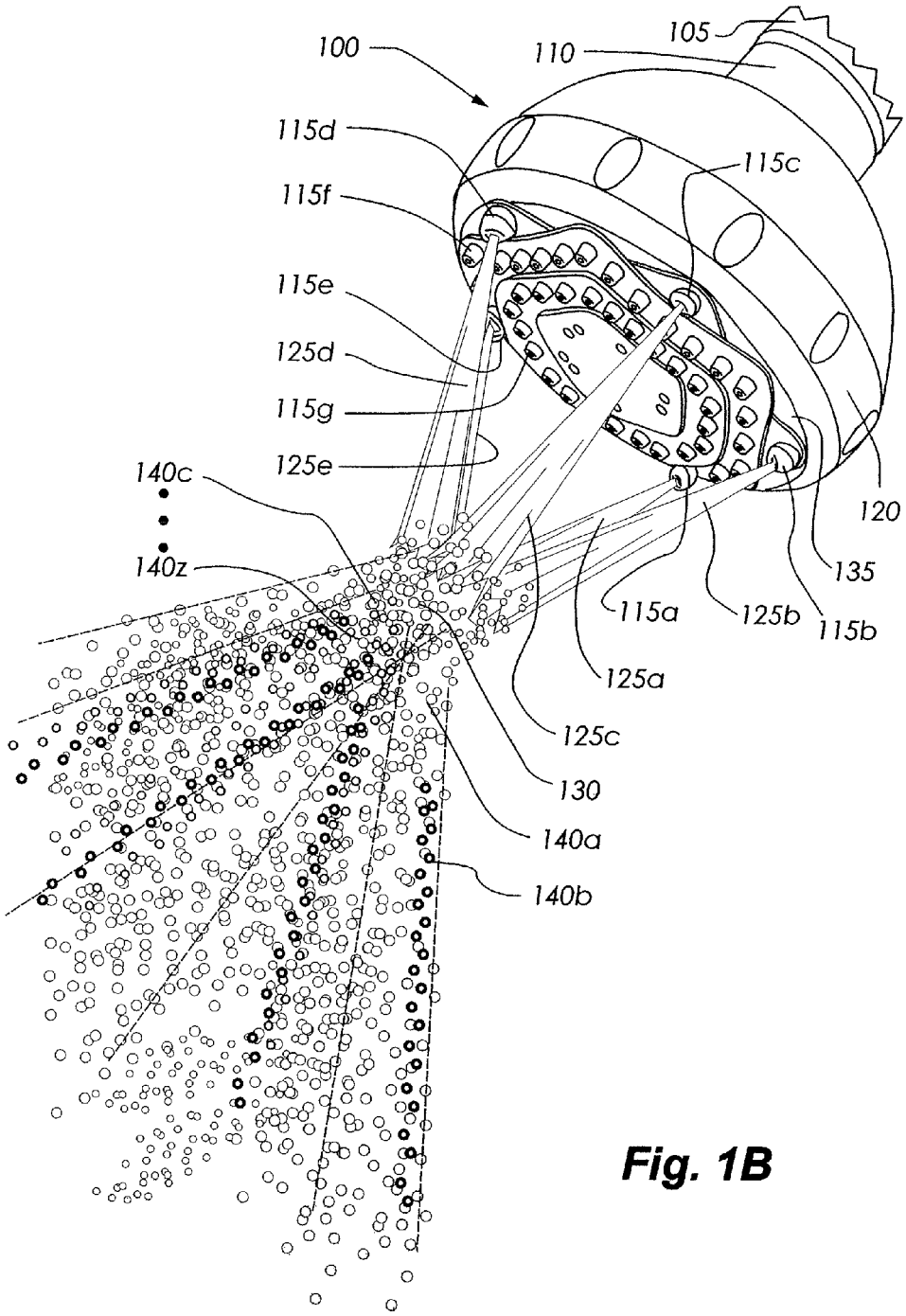
FIG. 1B is another front perspective view of the showerhead depicted in FIG. 1 with the converging streams shown representatively.

FIGS. 1A and 1B depict a first example of a showerhead 100 with converging sprays. The showerhead 100 may have a water inlet for receiving water from a shower pipe 105 or other water source and a connection portion 110 for attaching the showerhead 100 to the shower pipe 105 (either directly or indirectly). The showerhead 100 may include one or more flow paths (not shown) for directing water received from the shower pipe 105 (or other water source) to one or more showerhead nozzles 115*a-g*. Each flow path may be selectively opened or closed using a rotating ring 120 or other selection device to allow or prevent water flow to one or more showerhead nozzles 115*a-g* in fluid communication with the flow path. Selectively controlling the water flow to the nozzles 115*a-g* may permit a showerhead 100 to operate in one or more modes. For example, certain flow paths be may selectively opened or closed to create a high pressure, a mist, or a pulsating water flow from the showerhead 100. The foregoing example is merely illustrative of some potential modes of operation for a showerhead. Accordingly, the nozzles and flow paths in a showerhead may be configured to create any suitable mode or modes of operation, including any of the aforementioned modes.

Each showerhead nozzle 115*a-g* may be configured to form a certain shaped flow stream when water exits the showerhead 100 through the showerhead nozzle 115*a-g*. For example, a showerhead nozzle may create a water stream with a circular, fan, cruciform, cone, partial cone, or other suitable shape. Further, two or more of the showerhead nozzles 115*a-e* may be configured so that their respective water streams 125*a-e* converge at a region 130 in space. For example, the exits for the showerhead nozzles 115*a-e* may be configured to deliver their respective streams 125*a-e* at a radial inwardly and downwardly sloping angle relative to the showerhead face 135 to cause the streams 125*a-e* to converge at a common region 130. As another example, the positions of the nozzles relative to each other and/or the sizes of the streams exiting the nozzles may be configured for the edge portions of adjacent streams to intersect at one or more regions. The foregoing examples are merely illustrative and other methods for converging at least portions of water streams exiting the showerhead 100 to a common region or regions may be used.

The shape and flow rate of the water streams 125*a-e* that converge at a region 130 in space may be designed such that when the streams 125*a-e* converge, multiple water droplets 140*a-z* are formed from the converging streams 125*a-e*. Prior to convergence, each converging stream 125*a-e* may generally resemble the shape formed by the nozzle 115*a-e* from which it exited as shown, for example, in FIG. 1B. Upon convergence, each converging stream 125*a-e* may generally cease to substantially resemble the shape formed by the nozzle 115*a-e* from which it exited since each water stream may be substantially dispersed into multiple, randomly distributed droplets 140*a-z*. In some embodiments, however, the convergence may cause a partial dispersion of the streams into multiple, randomly distributed water droplets while at least some portions of one or more of the converging streams may maintain at least a portion of their original stream shape and may continue to move along the original trajectory absent any interference with another stream. Thus, a converging water stream may flow out of a nozzle as a stream for a distance, then may at least partially contact at least one other stream to substantially break at least portions of these streams into droplets.

The two or more converging water streams may converge, partially or completely, at one or more regions prior to the water from the streams contacting the showerhead's user. Since shower users typically stand about 18 inches or so away from a showerhead when showering, each converging water stream may converge at one or more regions approximately 18 inches or closer from the showerhead. The maximum flow rate for a water stream to be partially or substantially broken into multiple droplets upon convergence with one or more other water streams may depend upon the shape of the water stream and the shape and flow rates of the other converging streams. Additionally, each water stream that converges with one or more other water streams may optionally have a shape and flow rate similar to the streams with which it is converging. Thus, nozzles 115*a-e* designed to cause their respective streams 125*a-e* to converge at least partially with other streams may be configured to form water streams 125*a-e* having similar shapes, as shown, for example, in FIG. 1B.

The showerhead 100 shown in FIGS. 1A and 1B may have five nozzles 115*a-e* configured to form five water streams 125*a-e* that converge at a region 130 in space approximately five inches in front of the showerhead. Although described as approximately five inches from the showerhead 100, the region 130 may be designed to be closer or further than five inches from the showerhead 100 if desired. Upon convergence, the five water streams 125*a-e* may substantially break into multiple water droplets 140*a-z*. Portions of each stream 125*a-e*, however, may continue on their original trajectory depending upon factors such as the speed of the stream, the relative portion of the stream contacting other streams, the shape of the stream, and so on. Thus, the five water streams 125*a-e* flow out of their respective nozzles 115*a-e* for about five inches and then contact each other, thereby causing at least portions of each water stream 125*a-e*, up to and including the whole water stream, to substantially break into multiple water droplets 140*a-z*.

Although five water streams 125*a-e* are shown as converging in FIGS. 1A and 1B, more or less water streams may be caused to converge at this region 130 or other regions. Further, two or more nozzles may be configured to cause two or more water streams to converge at two or more regions. For example, a showerhead may have four nozzles with two nozzles configured to have their respective water streams converge at a first region and the other two nozzles configured to have their respective water streams converge at a second region. Continuing with the example, these different groups of nozzles may operate in separate, distinct modes, or may operate in the same mode. As another example, a showerhead may have twelve nozzles with six nozzles configured to have their respective water streams converge at a first region, three other nozzles configured to have their respective water streams converge at a second region, and the remaining three nozzles configured to have their respective water streams converge at a third region. Again, each group of nozzles may operate in a separate mode or may operate concurrently with other groups of nozzles in the same mode. Thus, any number of showerhead nozzles may be configured to cause any number of water streams to converge at any number of regions in space, which may be selected to occur at any desired distance from the showerhead. Further, a group of nozzles delivering streams to a specific region may operate in a different mode or modes than other nozzles delivering streams to a different region, or may operate in the same mode or modes with these other nozzles.

Showerheads, if desired, may also include nozzles configured so that their water streams do not converge with water streams from other nozzles. Thus, some nozzles in a showerhead may be configured so that their water streams converge with water streams from other nozzles while other nozzles in the showerhead may be configured so that their water streams do not converge with water streams from other nozzles. In this way, converging and non-converging streams may be used on the same showerhead. Nozzles delivering converging and non-converging streams from the showerhead may function in the same mode or in separate modes. Thus, a showerhead may include modes in which each nozzle operating in the mode delivers a stream that converges with at least one other stream, modes in which each nozzle delivers a stream that does not converge with any other stream, and modes in which some nozzles deliver streams that converge with at least one other stream and other nozzles deliver streams that do not converge with any other stream.

Two or more showerhead nozzles may also be configured so that portions of their respective streams converge with portions of other streams at two or more regions. FIGS. 2-4B depict a second example of a showerhead 200 where portions of streams converge with portions of other streams at two or more regions. The showerhead body 205 for the second showerhead example may resemble a five pointed star in front plan view with arms 210*a-e* extending radially outward from a central portion 215. Each arm 210*a-e* may include a nozzle 220*a-e* positioned near an end portion of the arm 210*a-e* distal the central portion 215 of the showerhead body 205. Water may flow into the showerhead 200 from a shower pipe though a water inlet 225. From the water inlet 225, water may then flow to each nozzle 220*a-e* via flow paths connecting each nozzle 220*a-e* to the water inlet 225.

Each nozzle 220*a-e* may be configured to form a fan shaped water stream 230*a-e* in which the main, inner portion of each water stream 230*a-e* converge at a first region 240 to cause the water streams 230*a-e* to disperse into multiple droplets 245*a-z* as described in more detail above with respect to the first showerhead example 100. Additionally, edge portions of one or more water streams 230*a-e* may converge with edge portions of adjacent water streams 230*a-e* at another region 255, or regions, thereby causing the edge portions of one or more water streams 230*a-e* to disperse into multiple water droplets 260*a-z* at this other region 255, or regions. Thus, the central portion of each stream 230*a-e* may converge at a first region 240, while the edge portions may converge one or more regions 255 closer to the showerhead 200.

The second showerhead 200 example, or any showerhead, including any described herein, may be directly or indirectly joined to a showerhead pipe. For example, the showerhead 200 may be directly joined to the showerhead pipe using a showerhead connection portion 270. The showerhead connection portion 270 may be formed proximate the water inlet 225 and may take the form of internal threads (see, e.g., FIGS. 2 and 4A) that mate with threads formed on the showerhead pipe. The showerhead 200 may be directly joined to the showerhead pipe by other suitable methods, including, but not limited to, press fitting, clamping, welding, adhering, any combination thereof (including using threaded connections), and so on. An O-ring (not shown) or other sealing element may be located within the water inlet 225 to form a water-tight seal between the showerhead 200 and the shower pipe.

Figure 5A:
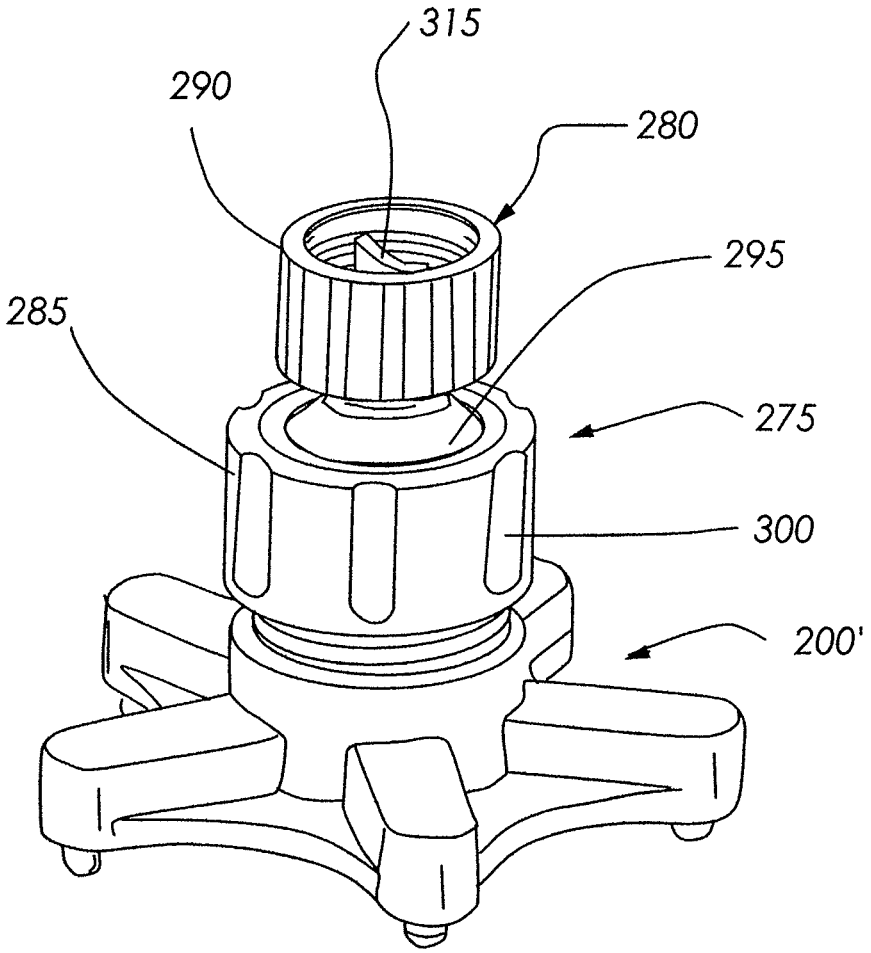
FIG. 5A is a perspective view of another second example of a showerhead showing another shower pipe connection structure.
Figure 5B:
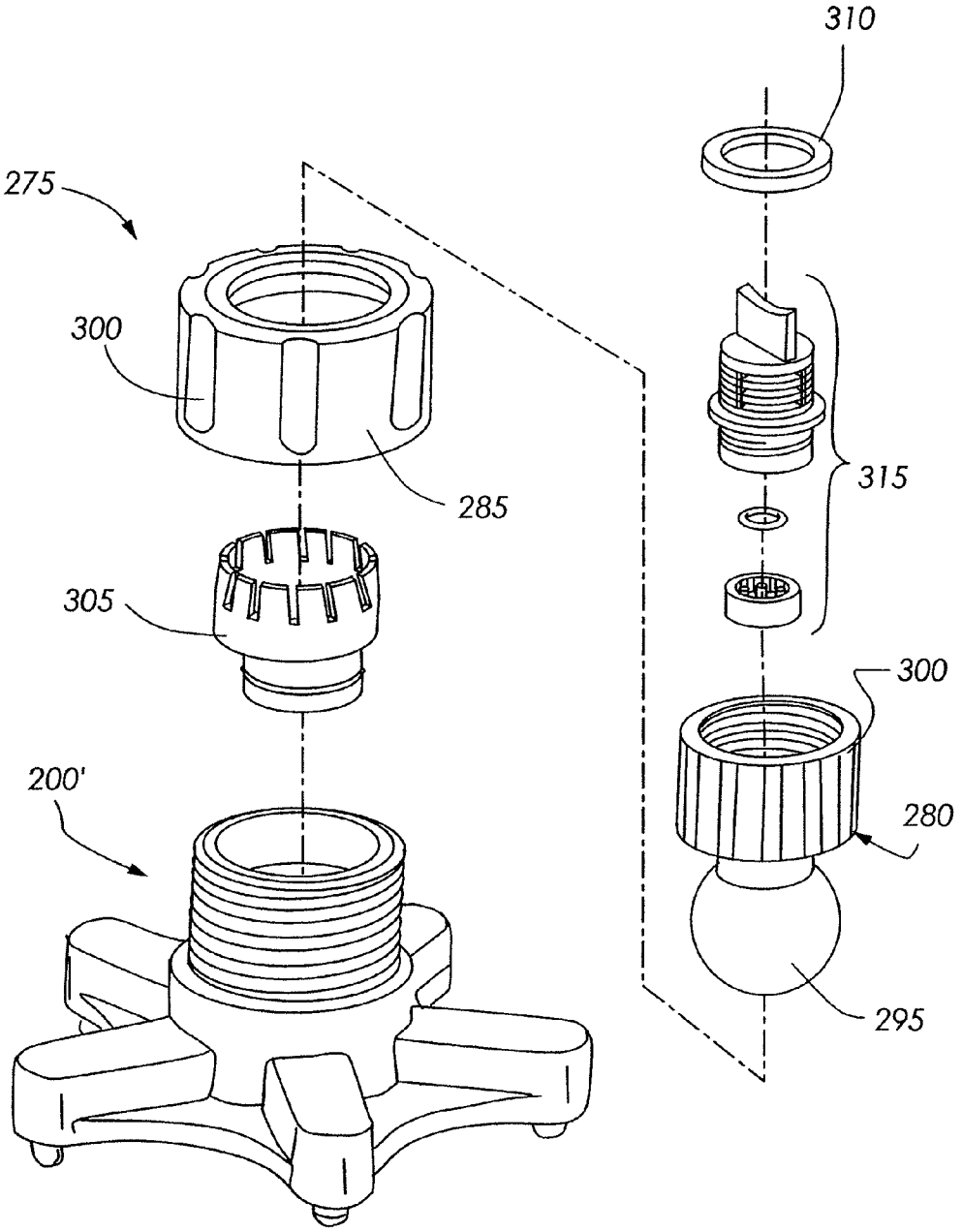
FIG. 5B is an exploded perspective view of the showerhead depicted in FIG. 5A.

As yet another example, the showerhead 200' may be indirectly joined to a showerhead pipe using a showerhead coupling assembly 275 or other suitable indirect connection method. With reference to FIGS. 5A and 5B, the showerhead coupling assembly 275 may include a ball joint member 280 movably joined to a coupling member 285, such as a coupling nut or the like. The ball joint member 280 may include a connection portion 290, such as a threaded end portion, for joining the ball joint member 280 to a showerhead pipe and a ball joint portion 295 for pivotally coupling the ball joint member 280 to the coupling member 285. The coupling member 285 may include a threaded portion for joining the coupling member 285 to the showerhead 200', and grooves 300 formed on its outer surface for facilitating grasping by a user when joining and removing the coupling member 285 from the showerhead 200'. Like the direct connection described above, joining approaches other than, or in combination with, threading members together may be used to join the coupling member 285 to the showerhead 200' and/or the ball joint member 280 to the showerhead pipe.

Still continuing with the example, the showerhead 200', when joined to the showerhead pipe by the coupling assembly 275, may be pivoted relative to the showerhead pipe by pivoting the coupling member 285 relative to the ball joint member 280. Such pivotal movement allows a user to change to the direction the showerhead nozzles face relative to the showerhead pipe. With continued reference to FIGS. 5A and 5B, the showerhead coupling assembly 275 may further include a cup seal 305, or other suitable seal, to prevent water from flowing outside of the showerhead 200' along the joint formed between the showerhead coupling member 285 and the showerhead 200'. An O-ring 310, or other suitable seal, may be placed between the showerhead ball joint member 280 and the showerhead pipe to prevent water from flowing through the joint formed between the showerhead ball joint member 280 and the showerhead pipe. If desired, a flow restrictor 315 may be positioned within the showerhead ball joint member 280 between the showerhead pipe and the showerhead ball joint member 280 to restrict the amount of flow received by the showerhead 200' from the showerhead pipe and/or to increase the pressure of the water exiting the showerhead 200'.

Figures 6, 7:
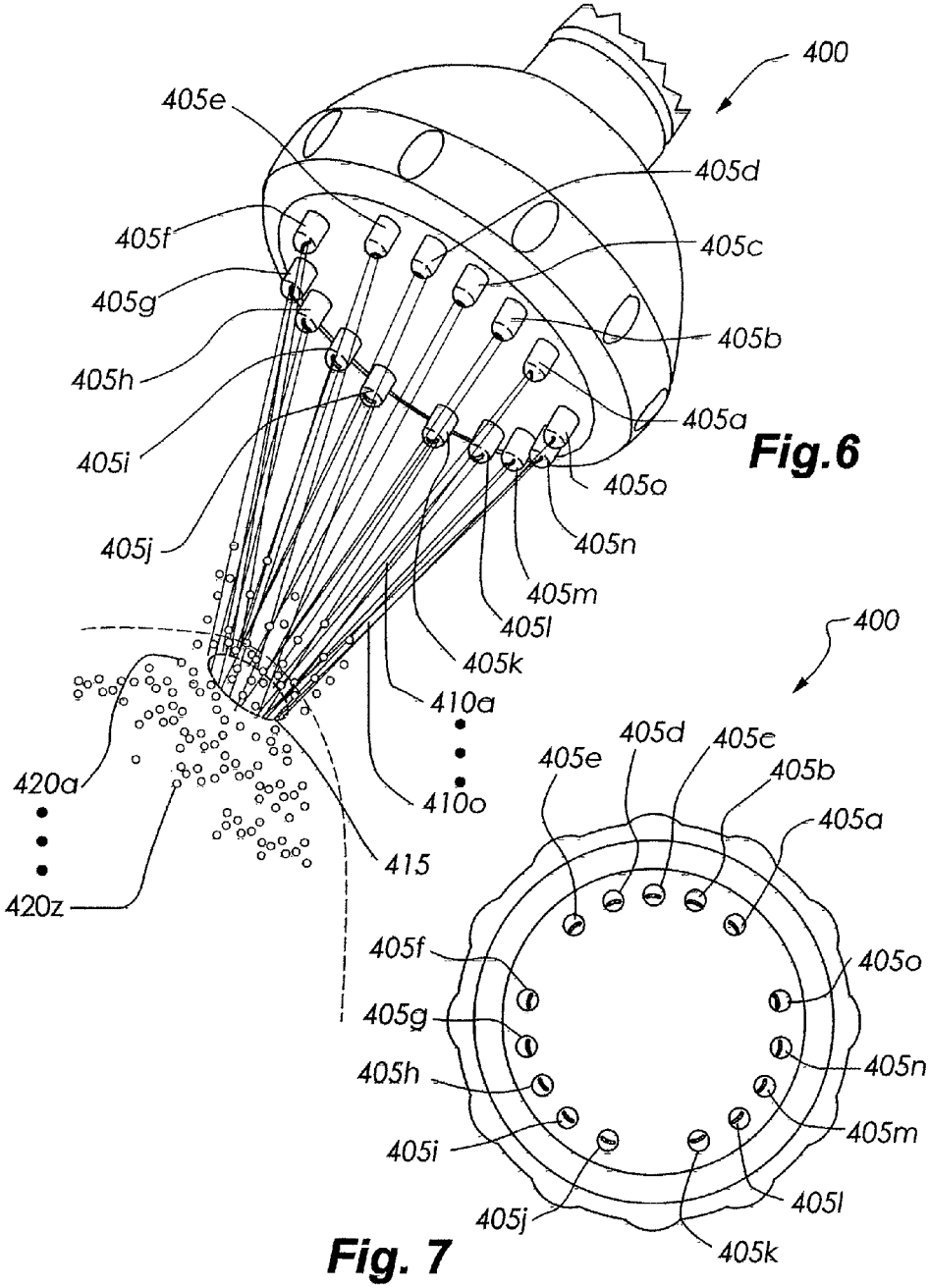
FIG. 6 is a perspective view of a third example of a showerhead.
FIG. 7 is a bottom view of the showerhead depicted in FIG. 6.
Figure 8:
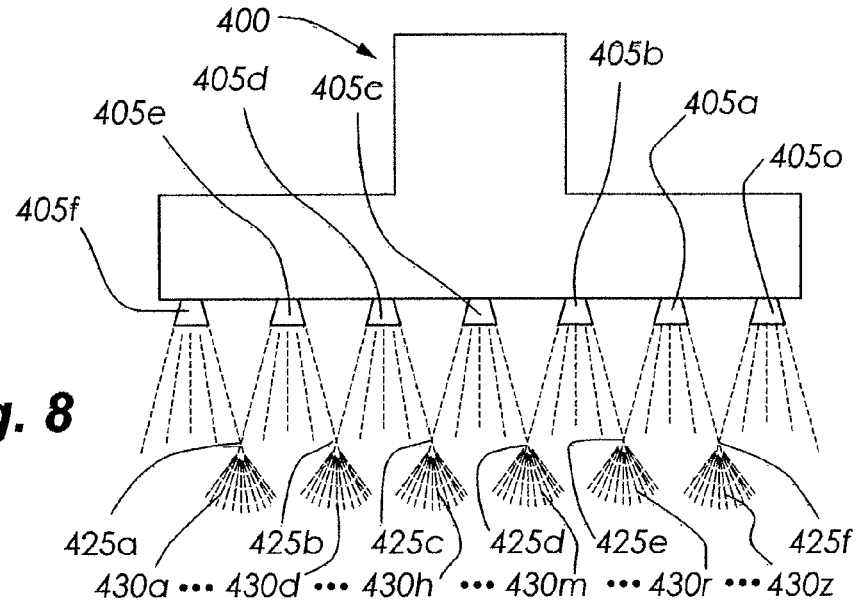
FIG. 8 is a schematic top view of the showerhead depicted in FIG. 6.

FIGS. 6-8 depict various views of a third example of a showerhead 400, which may have fifteen nozzles 405*a-o* arranged around the perimeter of the showerhead 400 in three groups of five nozzles. Similar to the second showerhead 200 example, each nozzle 405*a-o* may be configured to form a fan shaped water stream in which the main, inner portion of each water stream 410*a-o* converge at a first region 415 to cause the water streams 410*a-o* to disperse into multiple droplets 420*a-z* as described in more detail above with respect to the first showerhead 100 example. Similar to the water streams for the second showerhead 200 example, edge portions of one or more water streams 410*a-o* may converge with edge portions of adjacent water streams 410*a*-0 at second regions

425*a-f*, thereby causing the edge portions of the water streams 410*a-o* to disperse into multiple water droplets 430*a-z* at these second regions 425*a-f*.

Figure 9A:
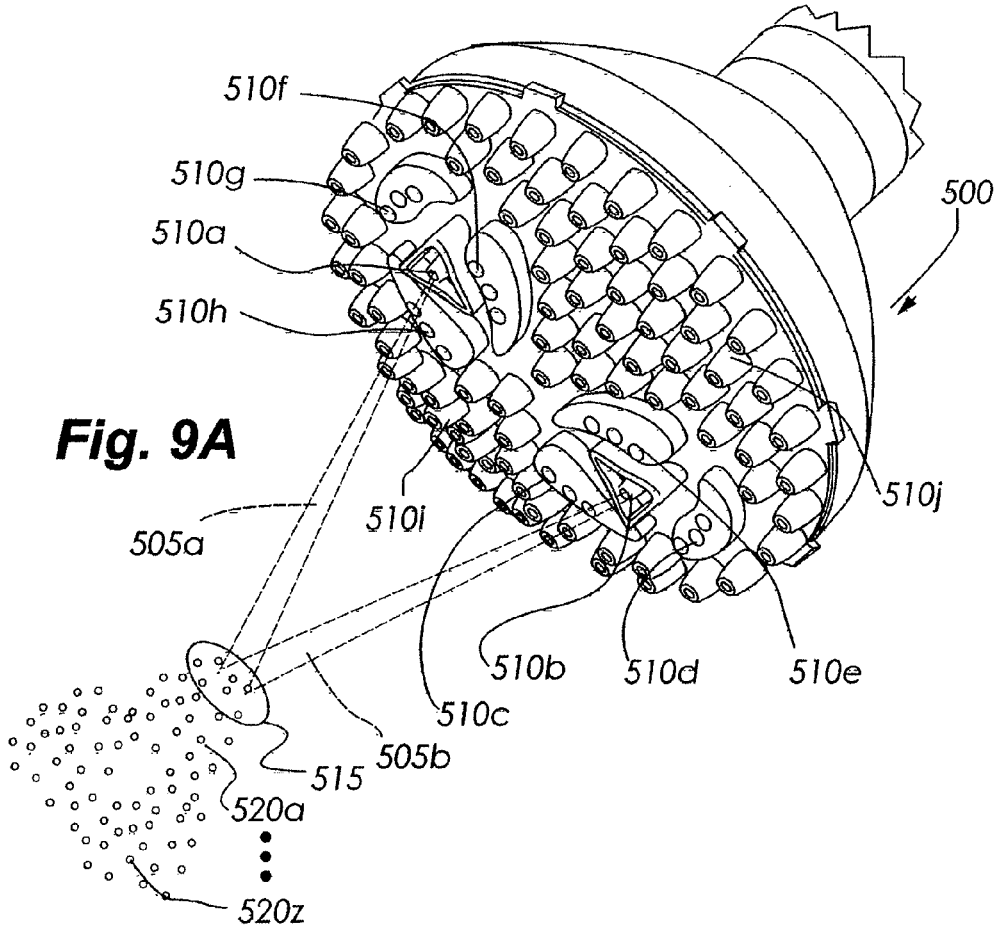
FIG. 9A is a perspective view of a fourth example of a showerhead, showing the showerhead operating in a first mode of operation.
Figure 9B:
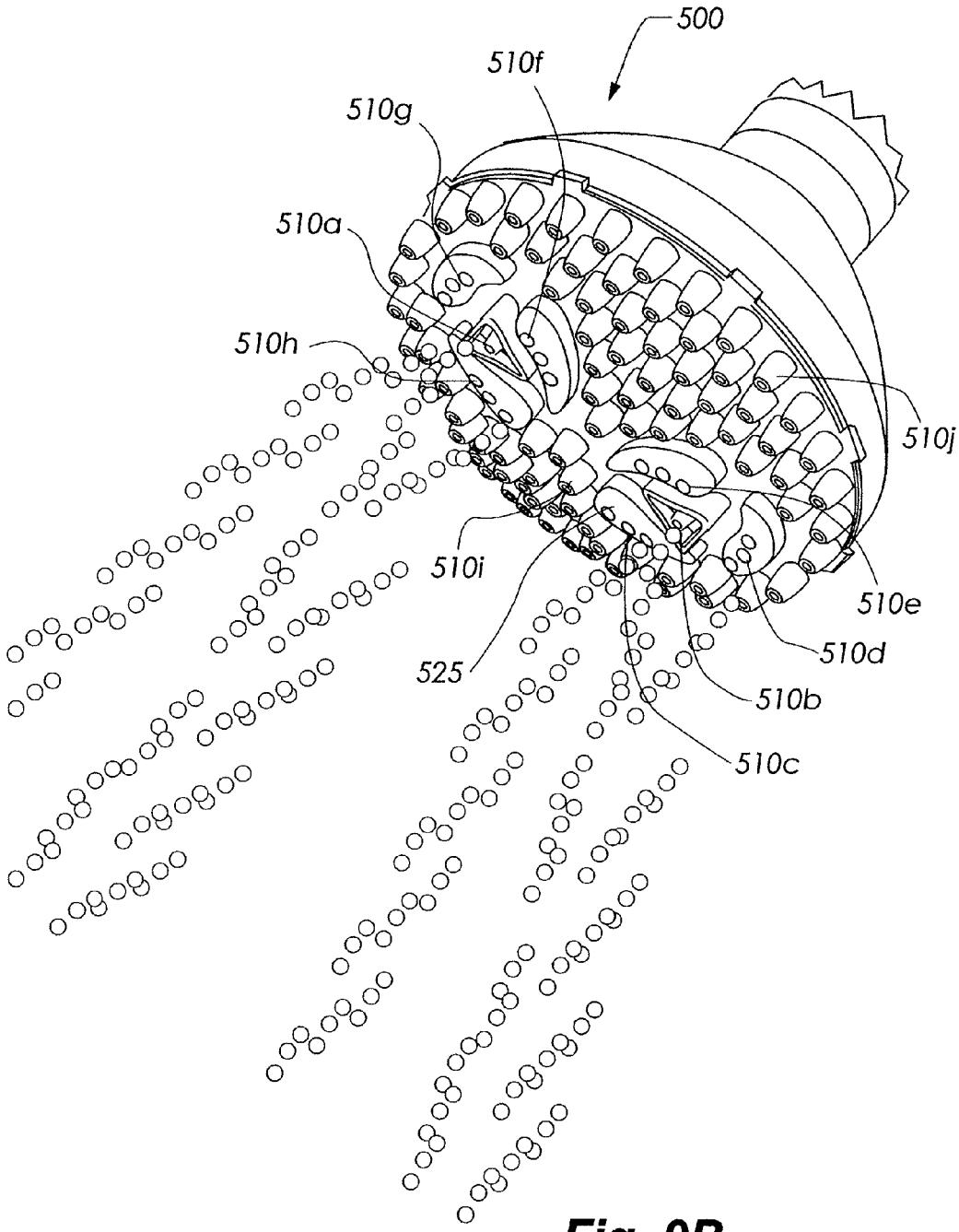
FIG. 9B is a perspective view of the showerhead depicted in FIG. 9A, showing the showerhead operating in a second mode of operation.
Figure 10:
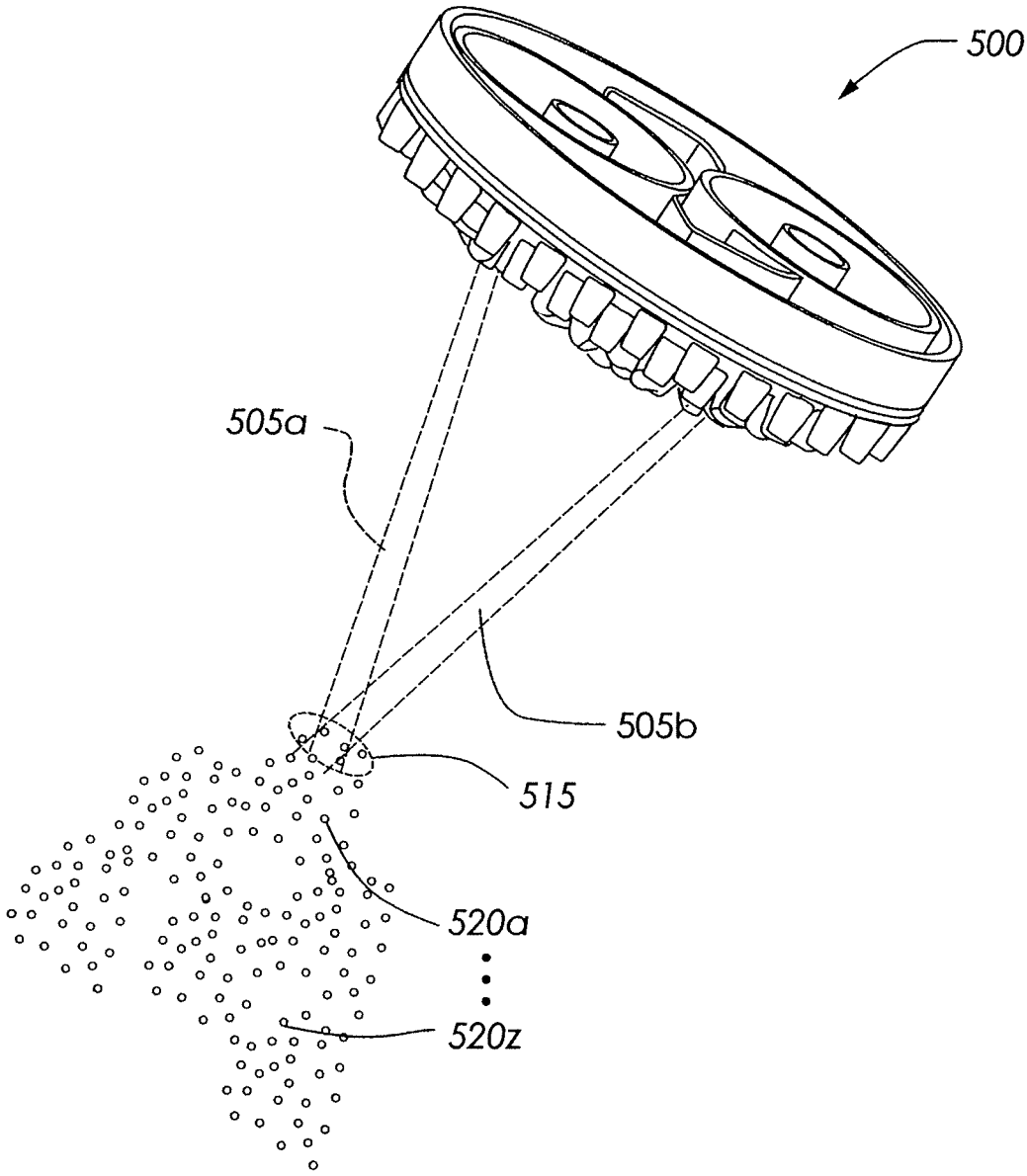
FIG. 10 depicts a rear perspective view of the showerhead depicted in FIG. 9A with the cover removed to show the fluid chambers contained within the showerhead body, which may be fluidly connected to the nozzles.
Figure 11:
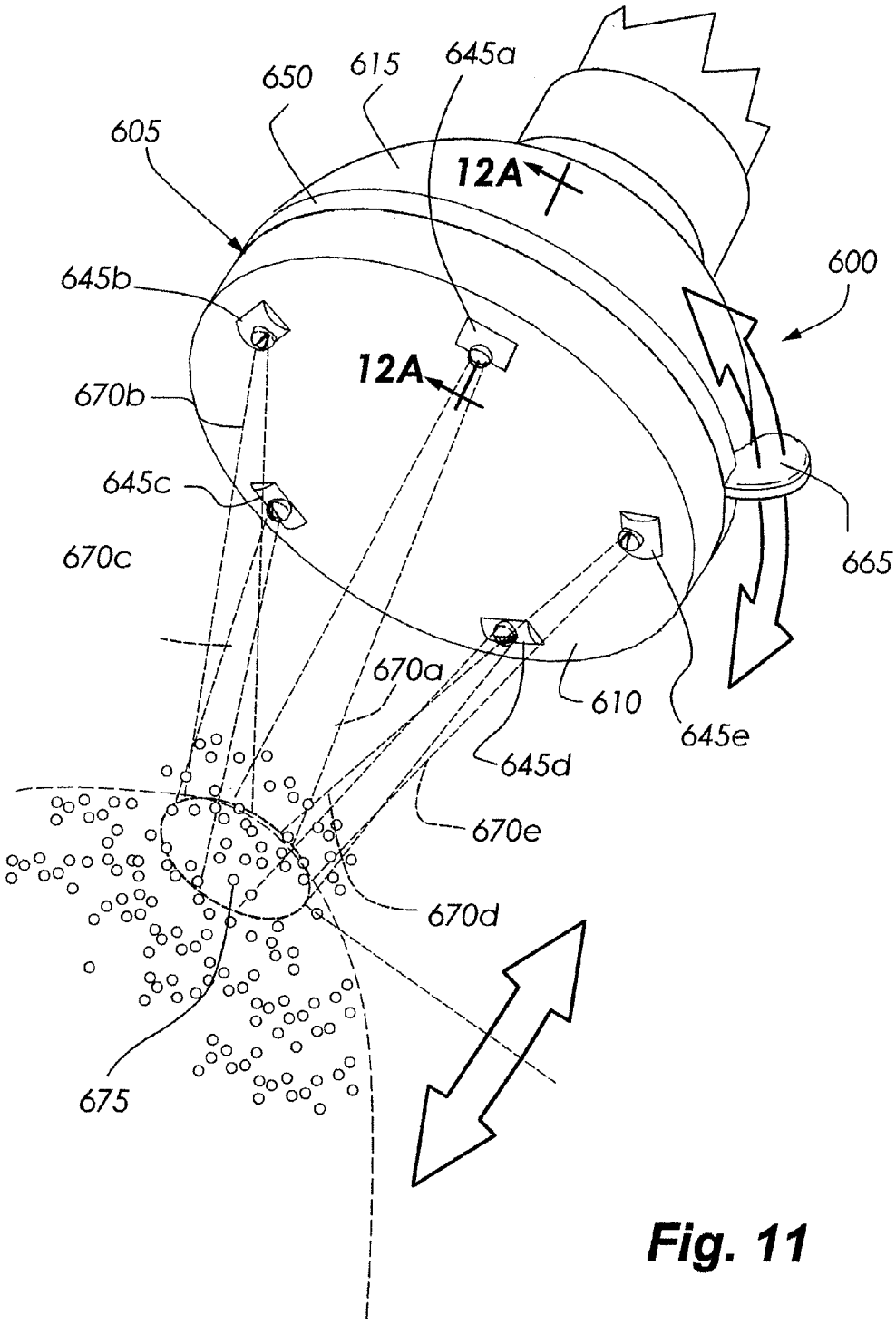
FIG. 11 is a perspective view of a fifth example of a showerhead

FIGS. 9A, 9B and 10 depict various views of a fourth example of a showerhead 500, which may include two diametrically opposed nozzles 510*a-b*. These two nozzles may be further configured so that their respective streams 505*a-b* converge at one or more regions 515 to form multiple droplets 520*a-z* in a manner similar to the one described above with respect to the previous showerhead examples. Water to these nozzles 510*a-b*, or to other nozzles 510*c-j*, may be supplied from fluid chambers formed in, or defined by, the showerhead body. These fluid chambers, in turn, may be in fluid communication with a water inlet for the showerhead 500.

The fourth showerhead 500 example may have other nozzles 510*c-j* for delivering water from the showerhead 500 in other modes such a high pressure mode, a pulsating mode, a mist mode, and so on. FIG. 9B, for example, shows the showerhead 500 operating in a pulsating mode with water delivered from the showerhead 500 through the nozzles (or openings) 510*c-h* formed in the tear-drop shaped structures 525. Any of these other nozzles 510*c-h* may also be configured, if desired, to cause their respective water streams to converge with other streams. As an example, pulsating streams, which pulsate synchronously, may be caused to converge to substantially break the converging, pulsating streams into water droplets. Additionally, the showerhead 500, or any showerhead with multiple modes, may be configured to deliver water concurrently in more than one mode, including at least one mode in which the water streams converge.

For any of the above described showerheads or any other showerhead with converging streams, the nozzles, or components joining the nozzles to the showerhead, may be selectively movable to selectively move the region or regions closer to or further away from the showerhead, or to selectively convert the nozzles from delivering converging to non-converging streams (or vice versa). FIGS. 11-13B depict a fifth example of a showerhead 600 showing one possible mechanism for such selective movement.

The fifth showerhead 600 example may include a showerhead body 605 formed from a showerhead face 610 and showerhead upper portion 615. The showerhead face 610 and a cam 650 may define a showerhead chamber 620 for receiving water from a shower pipe or the like joined to the showerhead upper portion 615 by a threaded connection, any connection method described herein for any other showerhead, or any other suitable joining method. The showerhead face 610 and showerhead upper portion 615 may each include fluid passage shafts 625, 630, which may be threaded together or otherwise suitably joined, to connect the showerhead face 610 to the showerhead upper portion 615 and to define a fluid passage between the showerhead fluid inlet 635 and the showerhead chamber 620. Fluid outlets 640 defined in the showerhead face's fluid passage shaft 630 may provide fluid communication between the fluid passage and the showerhead chamber 620. Other methods, such as tubes, channels, and so on, may be used to deliver fluid from the fluid inlet 635 to the showerhead fluid chamber and/or the shower nozzles 645*a-e*.

A cam 650 or other structure may be positioned between the showerhead upper portion 615 and showerhead face 610. The cam 650 may include a hub portion 655 for receipt on the showerhead upper portion's fluid passage shaft 625. The cam 650 may be rotated relative to the showerhead upper portion 615 and the showerhead face 610 around the showerhead upper portion's fluid passage shaft 625. The cam 650 may define one or more cam slots 660*a-e* for engaging nozzles 645*a-e* pivotally joined to the showerhead face 610. Movement of the cam 650, for example, by rotating the cam 650 using a hand grip 665 or other structure, may pivot the nozzles 645*a-e* relative to the showerhead 600 to adjust the angle the water streams 670*a-e* exit the nozzles 645*a-e* relative to the showerhead 600.

Figures 12A, 12B, 12C:
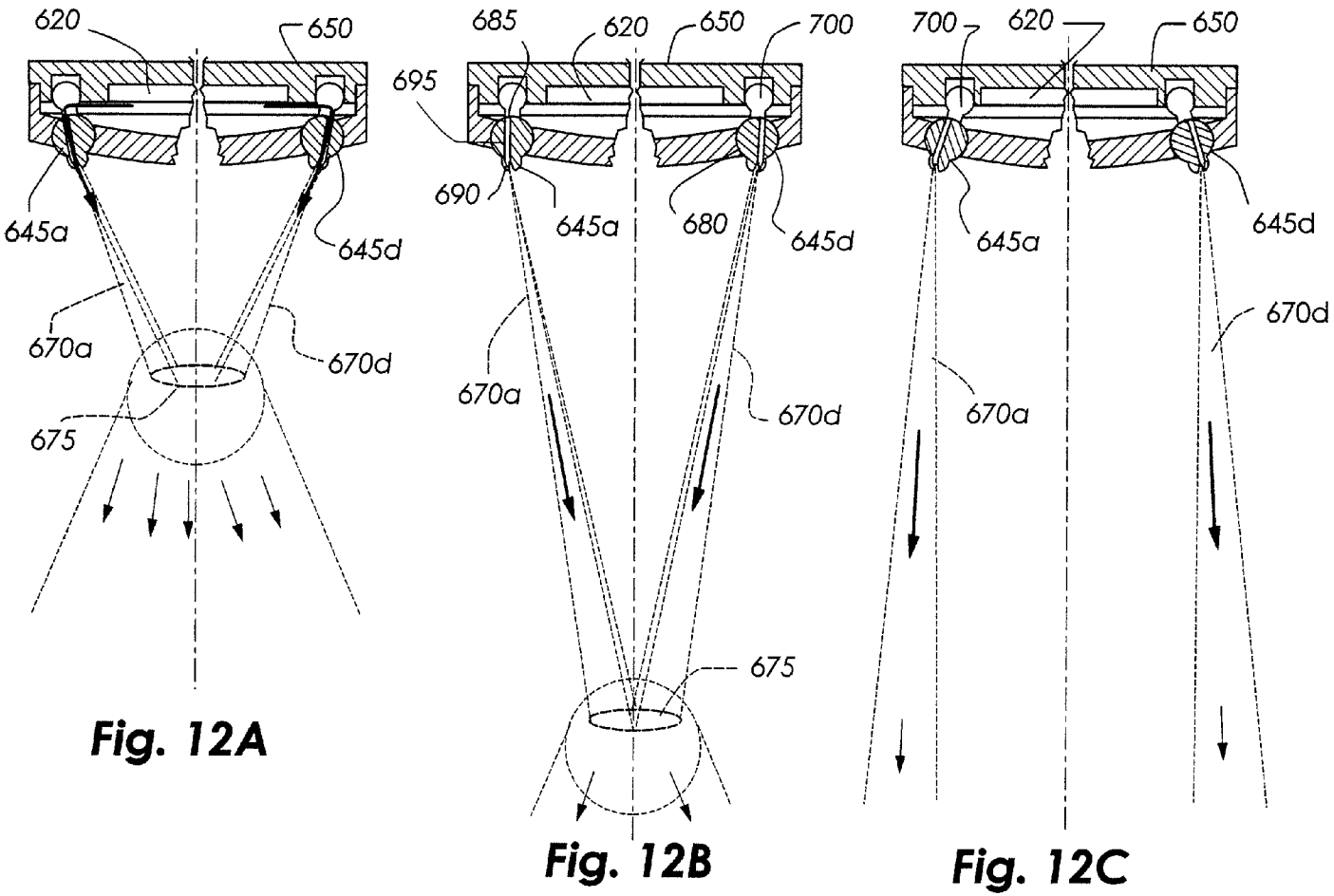
FIG. 12A is a partial cross-sectional view of the showerhead depicted in FIG. 11, viewed along line 12A-12A in FIG. 11 and showing the nozzles in a first position.
FIG. 12B is a partial cross-section view similar to the view shown in FIG. 12A, showing the nozzles after moving the nozzles to a second position.
FIG. 12C is a partial cross-section view similar to the view shown in FIG. 12A, showing the nozzles after moving the nozzles to a third position.
Figure 13B:
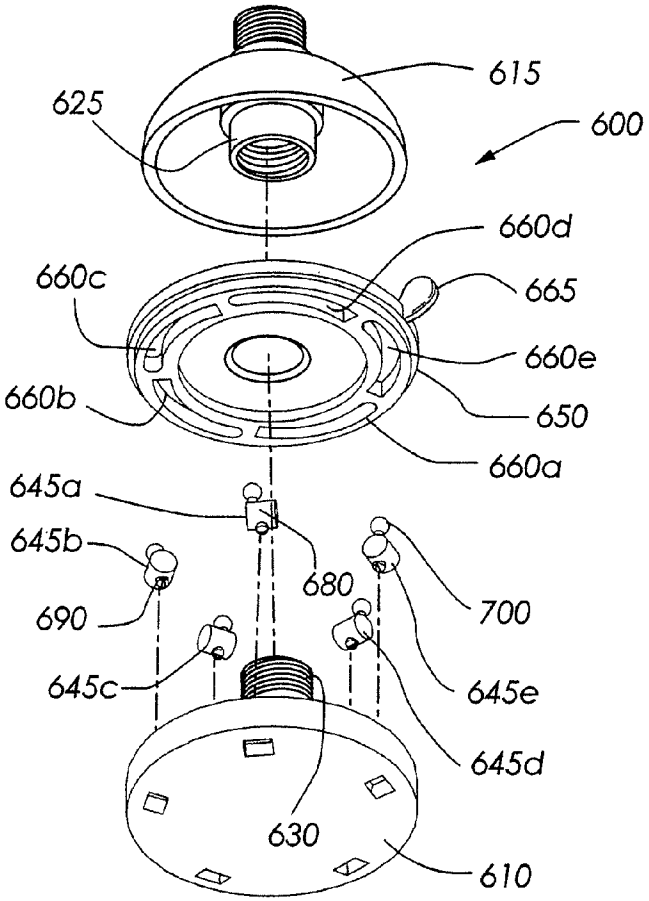
FIG. 13B is another exploded view of the showerhead depicted in FIG. 11.
Figure 13A:
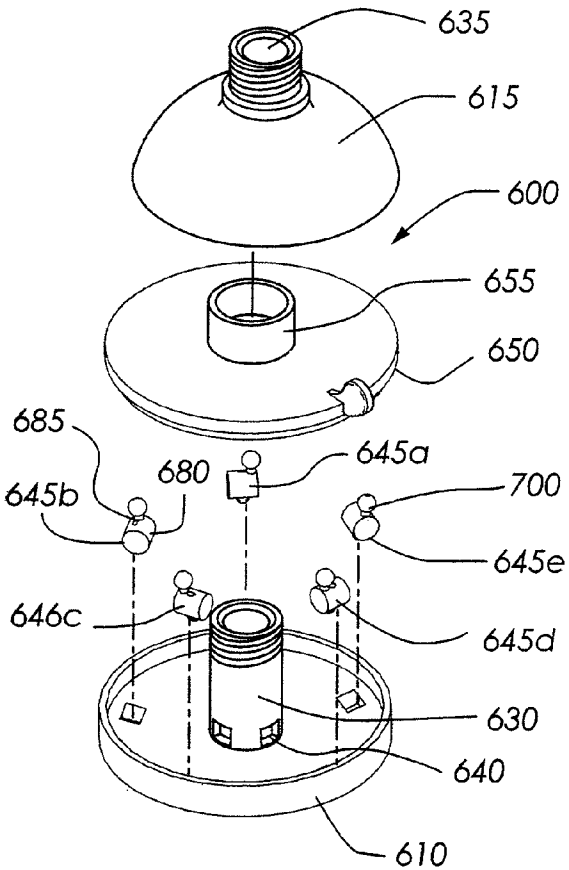
FIG. 13A is a exploded view of the showerhead depicted in FIG. 11.
Figure 14:
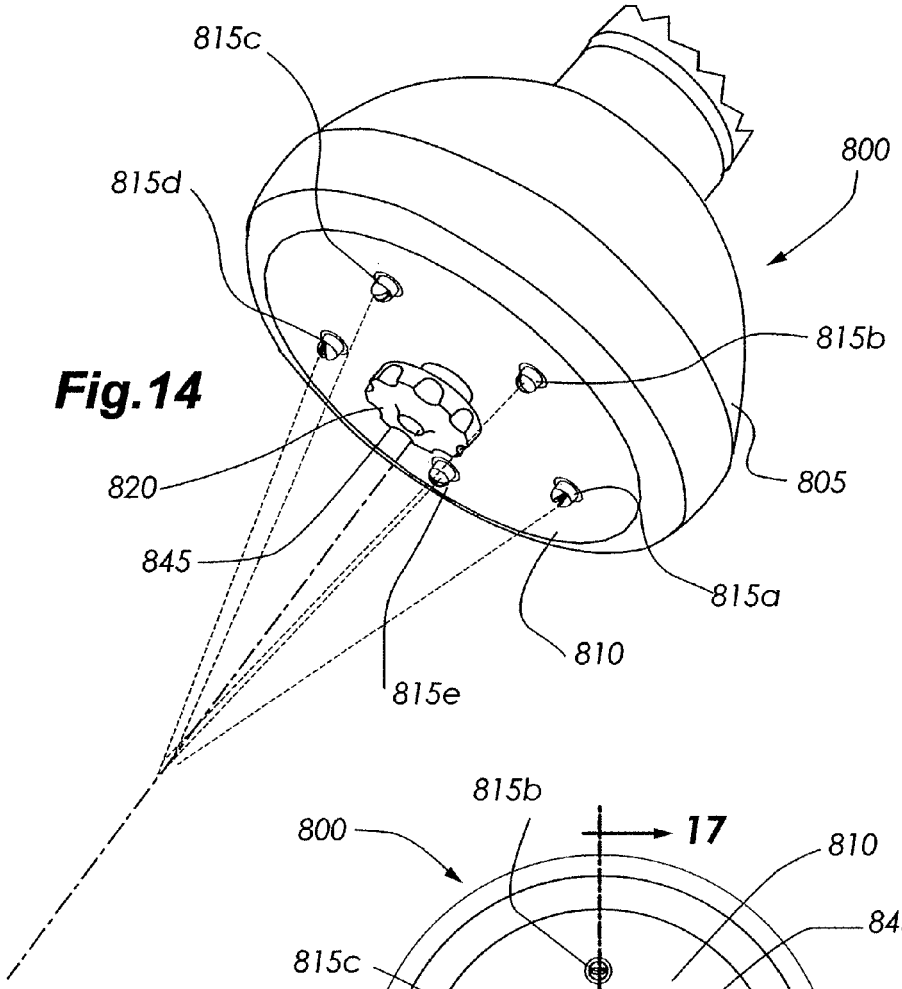
FIG. 14 is a perspective view of a sixth example of a showerhead.
Figure 15:
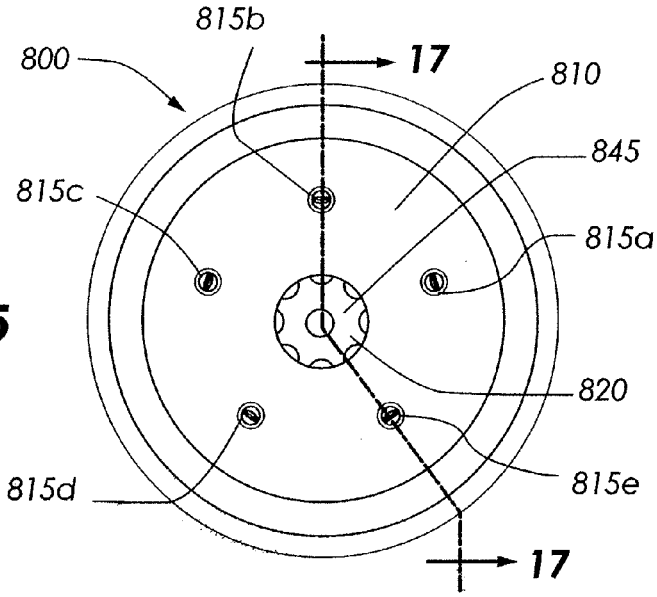
FIG. 15 is a bottom view of the showerhead depicted in FIG. 14.
Figure 16:
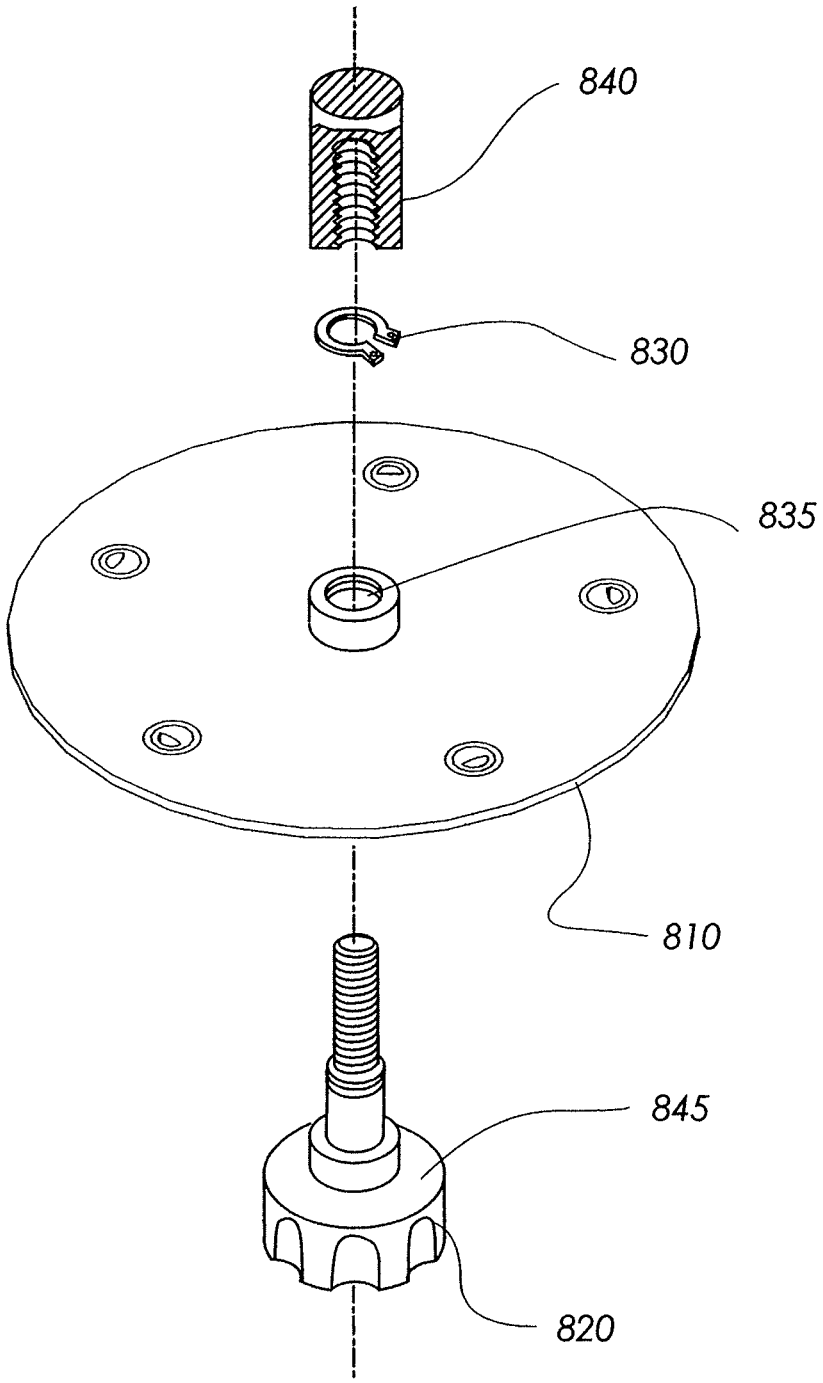
FIG. 16 is a partial exploded view of the showerhead depicted in FIG. 14, showing the flexible showerhead face plate and the adjustment mechanism for moving the showerhead plate from a planar to a curved profile, and vice versa.
Figure 18:
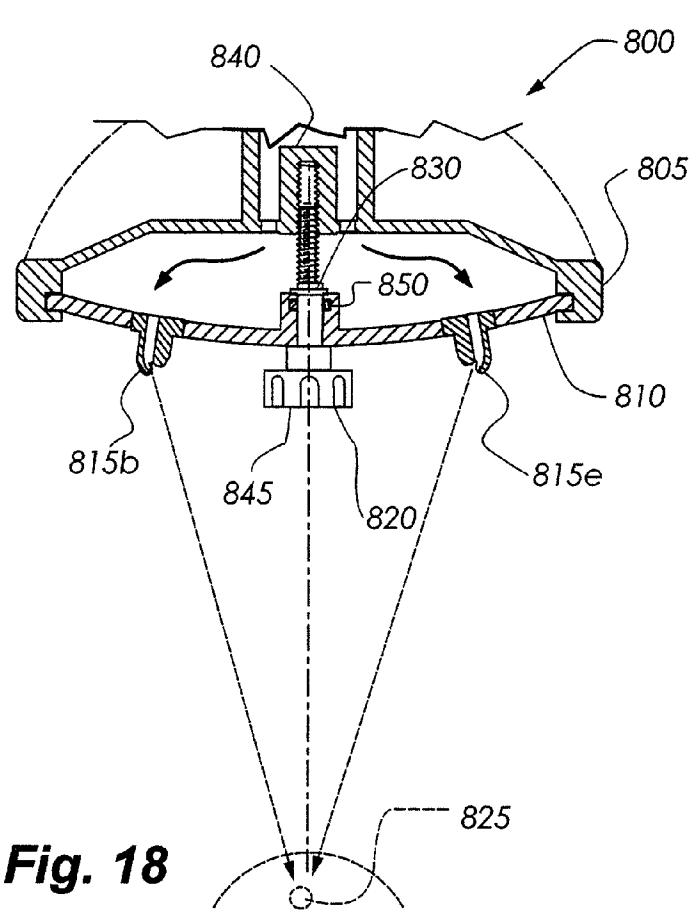
FIG. 18 is cross-section view similar to the view shown in FIG. 12A, showing the flexible plate in a outward convex position.
Figure 17:
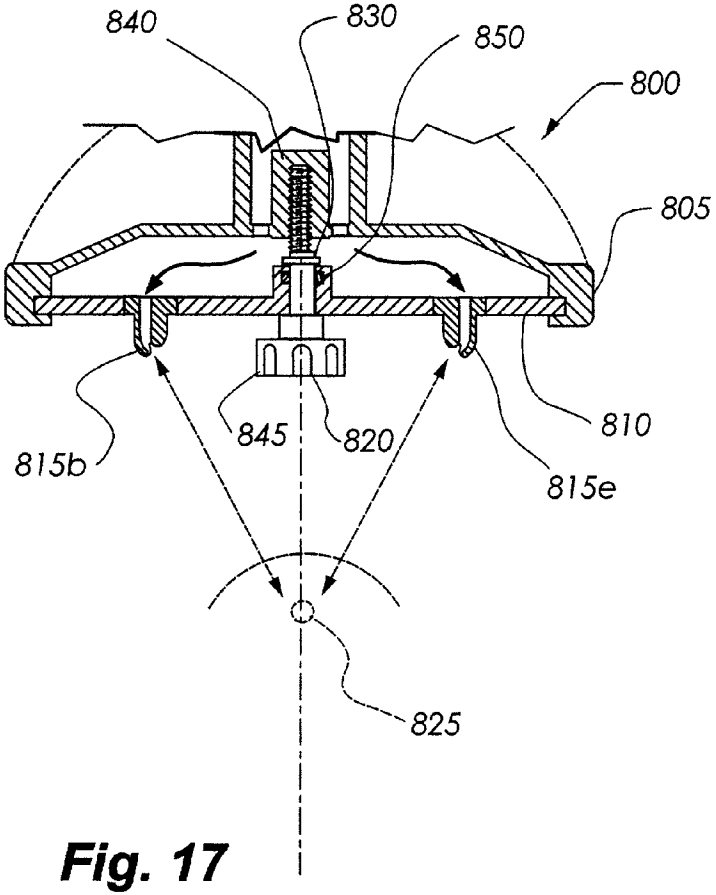
FIG. 17 is a partial cross-sectional view of the showerhead depicted in FIG. 14, viewed along line 17-17 in FIG. 15 and showing the flexible face plate in a substantially planar position.

With reference to FIGS. 12A-C, increasing the angle (as measured between the showerhead face 610 and a water stream 670*a-e*) moves the region 675 or regions of convergence further from the showerhead 600 (see, e.g., FIG. 12B), while decreasing the angle moves the region 675 or regions of convergence closer to the showerhead 600 (see, e.g., FIG. 12A). If desired, the nozzles 645*a-e* may be configured for selective conversion to and from delivering converging and non-converging streams. For example, the cam 650 and nozzles 645*a-e* may be configured such that the cam 650 may pivot the nozzles 645*a-e* relative to the showerhead 600 to a position where the streams 670*a-e* from one or more nozzles 645*a-e* that previously converged exit parallel or divergent to each other (see, e.g., FIG. 12C).

Each nozzle 645*a-e* may include a nozzle body portion 680 pivotally joined to the showerhead face 610 and defining a fluid inlet 685, a fluid outlet 690, and fluid passage 695 fluidly joining the fluid inlet 685 to the fluid outlet 690. Each nozzle 645*a-e* may further include a nozzle ball portion 700 for engagement with a cam slot 660*a-e* formed in the cam 650. The radial distance of each cam slot 660*a-e* from the center of the cam 650 may change along the length of the cam slot 660*a-e*, thus causing the nozzle 645*a-e* to pivot relative to the showerhead face 610 through engagement of the cam slot 660*a-e* with the nozzle ball portion 700. More particularly, as the radial distance of the cam slot 660*a-e* adjacent the nozzle ball portion 700 either increases or decreases by rotating the cam 650 relative to the showerhead face 610, the nozzle ball portion 700 moves away or towards the radial center of the showerhead face 610, thus causing the stream exiting the nozzle to rotate towards or away from the showerhead face 610 (i.e., decrease the relative angle or increase the relative angle.)

Although not shown, O-rings, cup seals, and so on may be used to seal the connections between the various components of the fifth showerhead 600 example, including connections between any of the showerhead upper portion 615, the showerhead face 610, the cam 650, and the nozzles 645*a-e*. Yet further, other types of cams or methods of pivoting or otherwise moving the nozzles relative to the showerhead may be used, if desired.

FIGS. 14-18 depict a sixth example of a showerhead 800 depicting yet another possible mechanism for changing the region of convergence. The showerhead 800 may include a showerhead body 805 joined to a flexible showerhead face plate 810. The showerhead face plate 810 may be formed from flexible rubber, flexible plastic, light-gauge metal, or other flexible material. An O-ring, cup seal, or other suitable sealing element or system may be positioned between the joint formed between the showerhead face plate 810 and the showerhead body 805 to prevent fluid leakage between these two components. Nozzles 815*a-e* may be joined to the showerhead face plate 810. The showerhead face plate 810 may be converted from a planar to an outwardly or convexly curved profile using a threaded screw 820 or other mechanical system, as shown, for example, in FIGS. 17 and 18. As the showerhead face plate 810 moves from a planar to a convex profile, the region 825 or regions of convergence moves further from the showerhead face plate 810. Similar to the mechanism described above, the nozzles 815*a-e* may be configured to convert from generating converging to non-converging streams as the showerhead face place 810 moves from a planar to a curved profile.

The mechanical system for moving the showerhead face plate 810 from a planar to a curved profile may include the threaded screw 820, or other suitable fastener, joined to the showerhead face plate 810 using a clip 830 or other joining element. The threaded screw 820 may be received through a fastening hole 835 or aperture defined in the showerhead face plate 810. The clip 830 may then be joined to the threaded screw 820 to maintain a joined relationship between the threaded screw 820 and the showerhead face plate 810. The threaded screw 820 may be received in a fastener shaft 840 formed in, or joined to, the showerhead body 805. Tightening the threaded screw 820 into the fastener shaft 840 moves the showerhead face plate 810 from a curved towards a planar profile, while loosening the threaded screw 820 moves the showerhead face plate 810 from a planar towards a curved profile. The threaded screw 820 may include a knob 845 for a user to grasp to facilitate tightening and loosening the threaded screw 820. An O-ring 850 or other suitable seal element may be positioned between the threaded screw 820 and the showerhead face plate 810 to prevent fluid leakage between these two elements. The above described mechanical system is merely illustrative of one possible mechanism for moving the showerhead face plate 810 from a planar to a curved profile, and vice versa, and is not intended to limit other potential systems, devices, or methods for achieving similar results.

The foregoing examples are merely illustrative of some mechanisms for changing the region or regions of convergence of the streams, or for converting the nozzles from delivering converging streams to delivering non-converging streams, and are not intended to limit other potential approaches to change the regions of convergence, or convert the nozzles from delivering converging to delivering non-converging streams (or vice versa).

In combination with, or in lieu of, causing water streams to converge to disperse into multiple droplets, other methods may be used to break water streams from showerheads into multiple droplets. For example, a showerhead may have a nozzle that delivers a rotating water stream with a sufficient angular velocity to break the stream into multiple droplets. As another example, one or more showerhead nozzles may be configured to deliver one or more water streams that impact a structure external to the showerhead (e.g., a plate), which causes the water streams to break into multiple droplets. As yet another example, one or more showerhead nozzles may be configured to deliver one or more water streams through a structure external to the showerhead (e.g., a screen), which causes the water streams to break into multiple droplets. Either of the structures (e.g., the plate or the screen) may or may not be connected to the showerhead.

Any of the various showerheads or showerhead components described herein may be composed of plastic, metal, any other suitable material, or some combination thereof. Any of showerhead components may be joined or connected to other components by any suitable method, including, but not limited to, sonic or heat welding, mechanical fastening, adhering or gluing, and so on, and/or may be integrally formed with other components. Yet further, any of the showerhead components may be formed integrally, or may be formed from multiple pieces joined or otherwise connected by any suitable methods.

Figure 2:
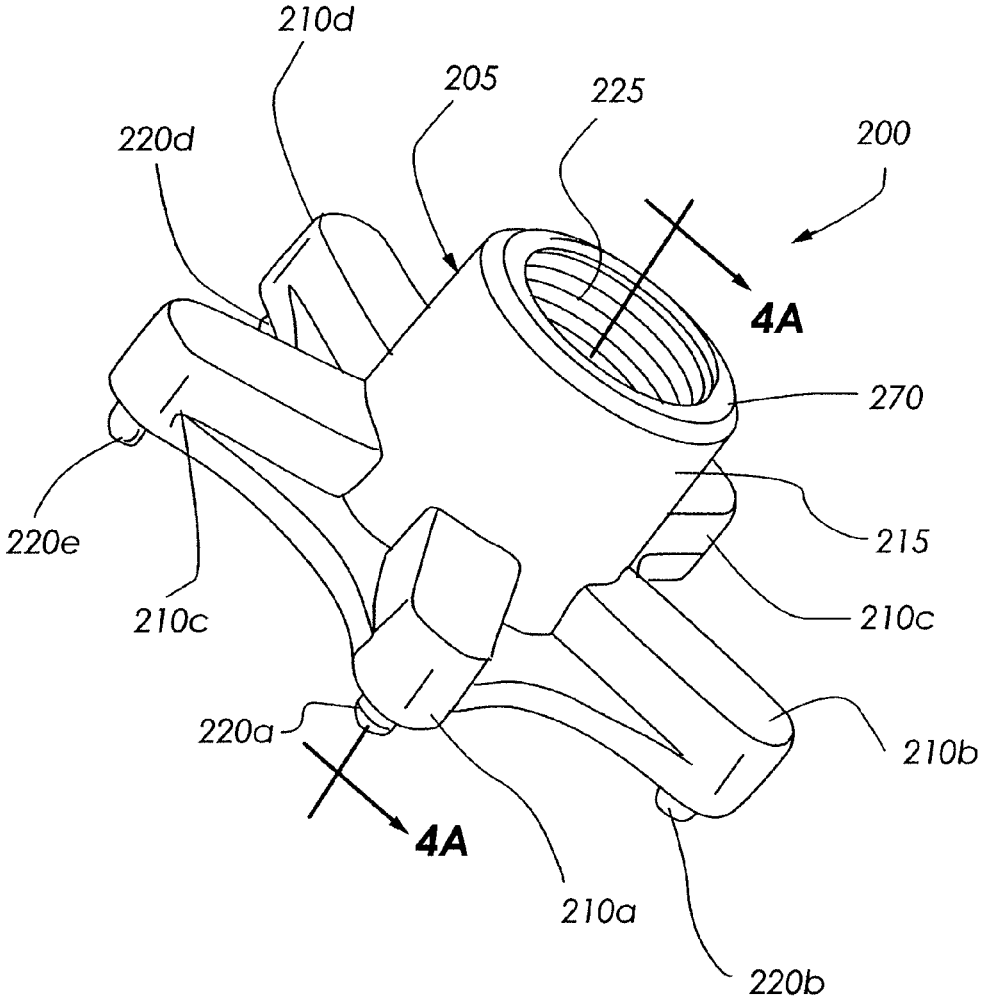
FIG. 2 is a perspective view of a second example of a showerhead showing a first shower pipe connection structure.
Figure 3:
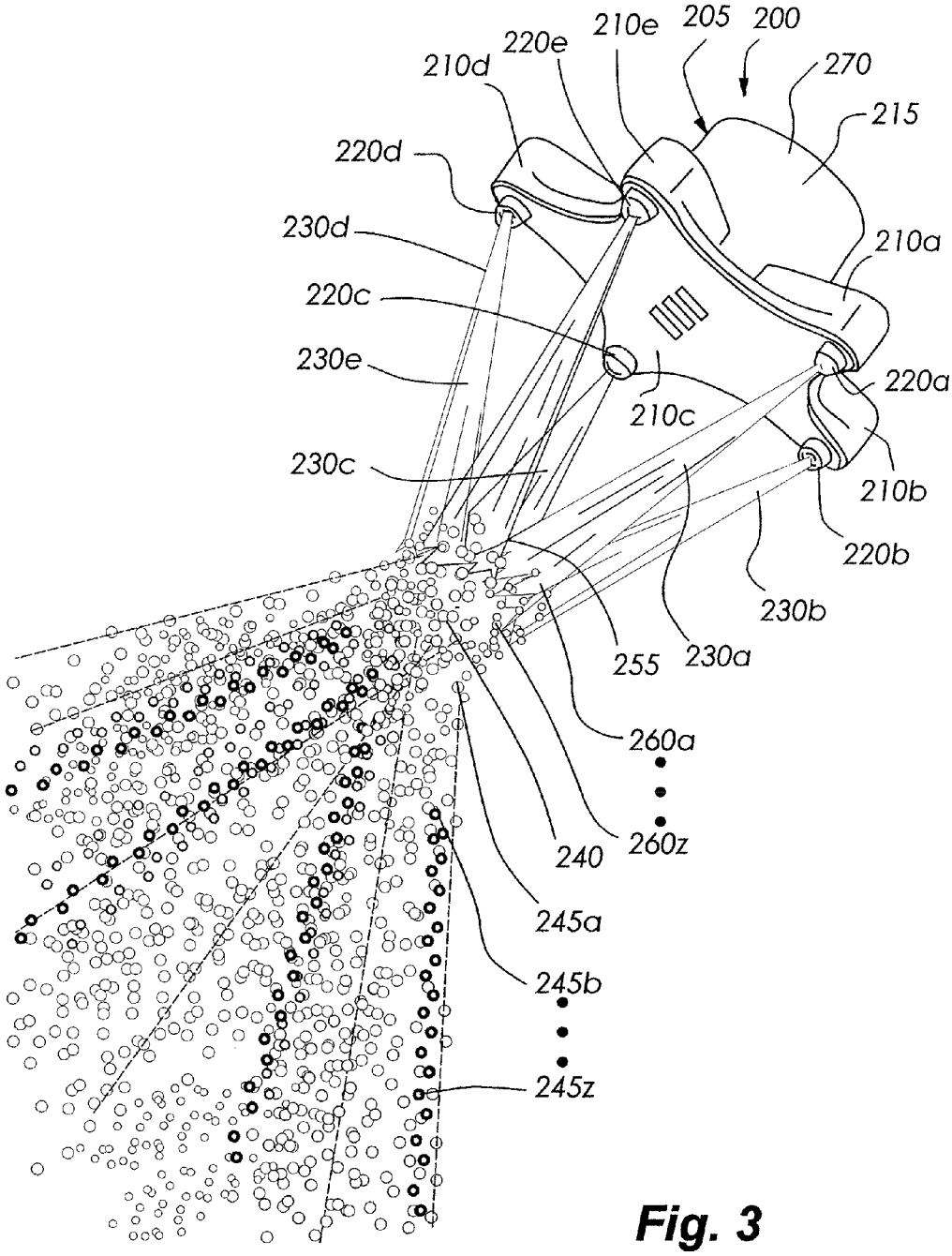
FIG. 3 is another perspective view of the showerhead depicted in FIG. 2.
Figure 4A:
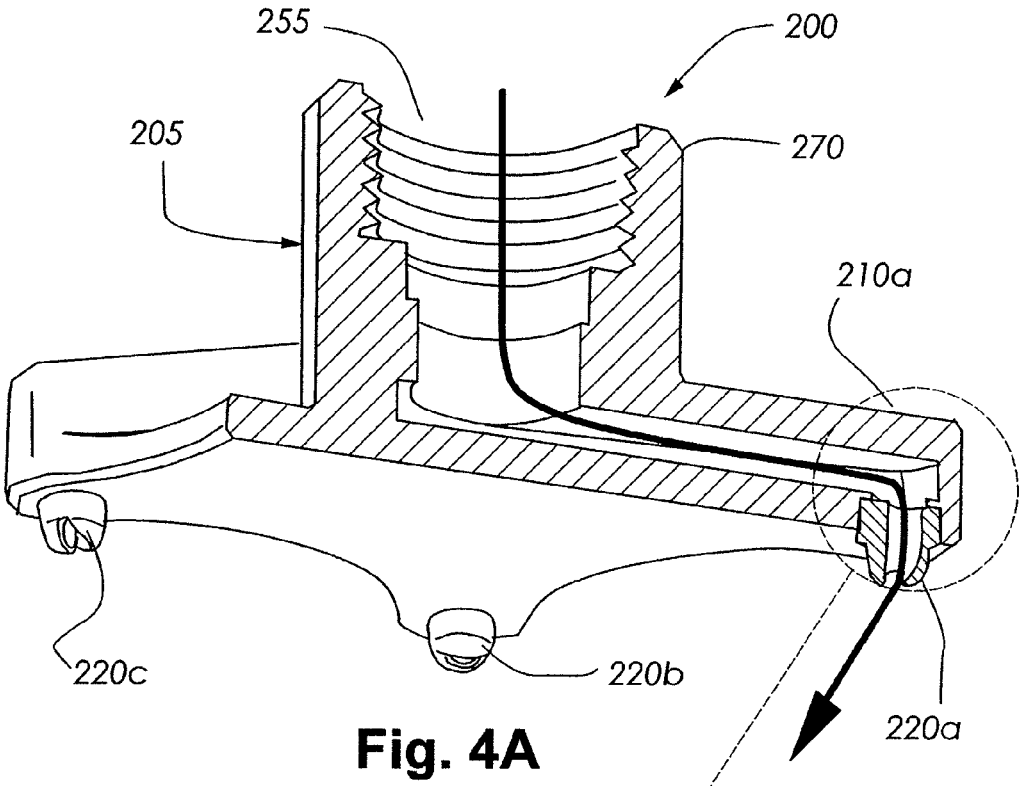
FIG. 4A is a cross-sectional view of the showerhead depicted in FIG. 2, viewed along line 4A-4A in FIG. 2.
Figure 4B:
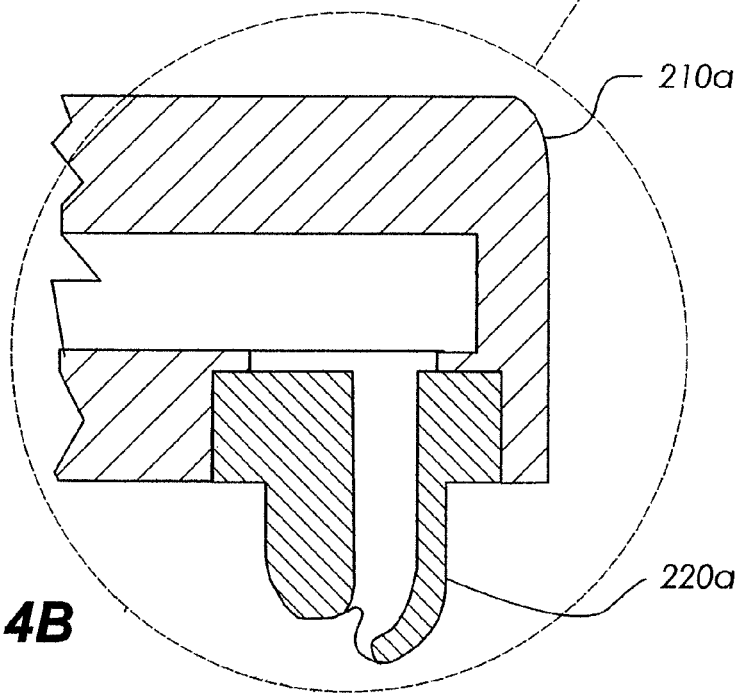
FIG. 4B is a detailed view of a showerhead nozzle for the showerhead depicted in FIG. 2.

Showerheads with alternate configurations for the showerhead body, and/or for the number and arrangement of showerhead nozzles, other than those described herein may be used to deliver at least one water stream from the showerhead that at least partially breaks into multiple droplets prior to contact with a person taking a shower. For example, a showerhead may have multiple nozzles configured to deliver water streams that converge only with the water stream of an adjacent nozzle. As another example, the showerhead body may be generally conical as depicted in FIGS. 1A, 6, and 9A, generally star shaped as depicted in FIGS. 2 and 5A or any other suitable shape. Accordingly the matter contained in the above description or shown in the accompanying drawings shall be interpreted as illustrative only and not limiting.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. Changes in detail or structure may be made without departing from the spirit of the invention as defined in the appended claims.

What is claimed is:

1. A showerhead comprising:

a water inlet;

a showerhead face;

a plurality of water channels in fluid communication with the water inlet; and a plurality of nozzles each of which is in direct fluid communication with a respective one of the plurality of water channels and operatively associated with the showerhead face, wherein at least two of the plurality of nozzles are configured to direct coherent water streams exiting the at least two of the plurality of nozzles to converge in at least one convergence region at a distance from the showerhead face to substantially break apart the coherent water streams and convert the coherent water streams into a cloud-like region of multiple water droplets.

2. The showerhead of claim 1, wherein the distance of each convergence region is approximately five inches or less from the showerhead face.

3. The showerhead of claim 1, wherein water streams having a common convergence region have a substantially similar shape.

4. The showerhead of claim 3, wherein the shape is selected from the group consisting of a fan, flat, conical, partially conical, helical, or cruciform shaped water stream.

5. The showerhead of claim 1, wherein water streams having a common convergence region have a substantially similar flow rate.

6. The showerhead of claim 1, further comprising a body defining the plurality of water channels for fluidly joining the water inlet to the plurality of nozzles.

7. The showerhead of claim 1, further comprising a showerhead coupling assembly selectively operatively associated with the water inlet.

8. The showerhead of claim 7, wherein the showerhead coupling assembly comprises a ball joint member pivotally connected to a coupling member.

9. The showerhead of claim 8, wherein selectively operatively associating the showerhead coupling assembly with the water inlet comprises selectively joining the coupling member to the water inlet.

10. The showerhead of claim 1, further comprising a threaded portion proximate the water inlet.

11. The showerhead of claim 1, wherein the showerhead includes at least two modes of operation.

12. The showerhead of claim 11, wherein at least one of the two modes of operation comprises delivering water streams from the at least two of the plurality of nozzles.

13. The showerhead of claim 12, wherein at least one other of the two modes of operation comprises delivering a pulsating stream from the plurality of nozzles.

14. The showerhead of claim 1, wherein the at least two of the plurality of nozzles includes at least five nozzles configured such that water streams existing the at least five nozzles converge at a common convergence region to substantially convert at least portions of the water streams from the at least five nozzles into multiple water droplets.

15. The showerhead of claim 1, wherein at least one of the at least one convergence region is selectively movable relative to the showerhead.

16. The showerhead of claim 15, further comprising a flexible face plate selectively movable from at least a first position to a second position, the at least two nozzles joined to the flexible face plate, wherein moving the at least one selectively movable convergence region comprises moving the showerhead plate from a first position to a second position.

17. The showerhead of claim 1 further comprising an adjustment device operable to conjointly adjust positions of the at least two of the plurality of nozzles to thereby adjust an angle of the coherent water streams and thus a location of the convergence region.

18. The showerhead of claim 17, wherein the nozzles are pivotably connected to the showerhead face, the adjustment device comprises a cam rotatably connected to the showerhead face, the cam comprising a plurality of cam slots, each cam slot engaged with one of the plurality of nozzles, and when the cam rotates with respect to the showerhead face, a movement of the cam slots cause the plurality of nozzles to pivot with respect to the showerhead face.

19. The showerhead of claim 17, wherein the showerhead face further comprises a flexible faceplate upon which the at least two of the plurality of nozzles are mounted; and the adjustment device adjusts the flexible faceplate between a substantially flat form and an outwardly convex form to conjointly adjust an angle of convergence of the coherent water streams.

20. The showerhead of claim 1 wherein the at least two of the plurality of nozzles each have unitary body that further defines a nozzle intake oath taken by water that enters the nozzle and nozzle outlet path taken by water that exits the nozzle, wherein the nozzle intake path is substantially parallel to a centerline of the water inlet and the nozzle outlet path is angled with respect to the centerline of the water inlet, and the angle of the nozzle outlet path determines an exit angle of the coherent water streams with respect to the showerhead face and thus a location of the convergence region.

21. The showerhead of claim 20, wherein a first diameter of the outlet path is smaller on the outlet side than a second diameter of the outlet path on the inlet side.

22. The showerhead of claim 1, further comprising an intermediate chamber fluidly connected between the water inlet and the plurality of water channels.

23. The showerhead of claim 1, wherein the at least two of the plurality of nozzles each have a unitary body that further defines a nozzle intake path taken by water that enters the nozzle and an internal nozzle path taken by water inside the nozzle, wherein the nozzle intake path is substantially parallel to a centerline of the water inlet and the internal nozzle path is curved with respect to the nozzle intake path, and a curvature of the internal nozzle paths creates an exit angle of the coherent water streams with respect to the showerhead face and thus a location of the convergence region.

24. The showerhead of claim 1, wherein all of the plurality of nozzles are configured to direct coherent water streams exiting the at least two of the plurality of nozzles to converge in at least one convergence region at a distance from the showerhead face to substantially break apart the coherent water streams and convert the coherent water streams into a cloud-like region of multiple water droplets.

* * * * *